US011262160B2

(12) United States Patent
Haugen

(10) Patent No.: US 11,262,160 B2
(45) Date of Patent: Mar. 1, 2022

(54) MODULAR STOCK FOR A FIREARM

(71) Applicant: GRS Riflestocks AS, Hornindal (NO)

(72) Inventor: Håvard Haugen, Hornindal (NO)

(73) Assignee: GRS Riflestocks AS, Hornindal (NO)

( * ) Notice: Subject to any disclaimer, the term of this patent is extended or adjusted under 35 U.S.C. 154(b) by 0 days.

(21) Appl. No.: 16/957,839

(22) PCT Filed: Dec. 20, 2018

(86) PCT No.: PCT/EP2018/086210

§ 371 (c)(1),
(2) Date: Jun. 25, 2020

(87) PCT Pub. No.: WO2019/129645

PCT Pub. Date: Jul. 4, 2019

(65) Prior Publication Data

US 2021/0063111 A1 Mar. 4, 2021

(30) Foreign Application Priority Data

Dec. 29, 2017 (NO) ..... 20172066

(51) Int. Cl.
*F41C 23/06* (2006.01)
*F41C 23/14* (2006.01)

(52) U.S. Cl.
CPC ..... *F41C 23/06* (2013.01); *F41C 23/14* (2013.01)

(58) Field of Classification Search
CPC ..... F41C 23/06; F41C 23/14; F41C 23/16; F41C 23/20; F41C 23/08; F41C 23/18; F41A 11/02
USPC ..... 42/73
See application file for complete search history.

(56) References Cited

U.S. PATENT DOCUMENTS 1,651,299 A * 11/1927 Stansel ..... F41C 23/14 42/73
5,970,642 A * 10/1999 Martin ..... F41C 23/14 42/73
D636,834 S * 4/2011 Mayberry ..... F41C 23/04 D22/108
7,984,580 B1 * 7/2011 Giauque ..... F41C 23/14 42/73
8,381,427 B2 * 2/2013 Nill ..... F41C 23/04 42/73
8,720,099 B1 5/2014 Sisk
(Continued)

FOREIGN PATENT DOCUMENTS

EP 3163248 A1 5/2017
TW M410210 U 8/2011

OTHER PUBLICATIONS

International Search Report issued in Application No. PCT/EP2018/086210, dated Mar. 4, 2019 (6 pages).
(Continued)

*Primary Examiner* — Joshua E Freeman
(74) *Attorney, Agent, or Firm* — Osha Bergman Watanabe & Burton LLP

(57) ABSTRACT

A modular stock for a firearm includes a foremost stock, an intermediate stock part and a buttstock. A butt plate is mounted to the buttstock through a first adjustment device. A cheek piece is mounted to the buttstock through a second adjustment device. The first adjustment device includes a first locking and releasing button. The first locking and releasing button is bilaterally operable.

14 Claims, 27 Drawing Sheets

(56) References Cited

U.S. PATENT DOCUMENTS

Figure 1A:
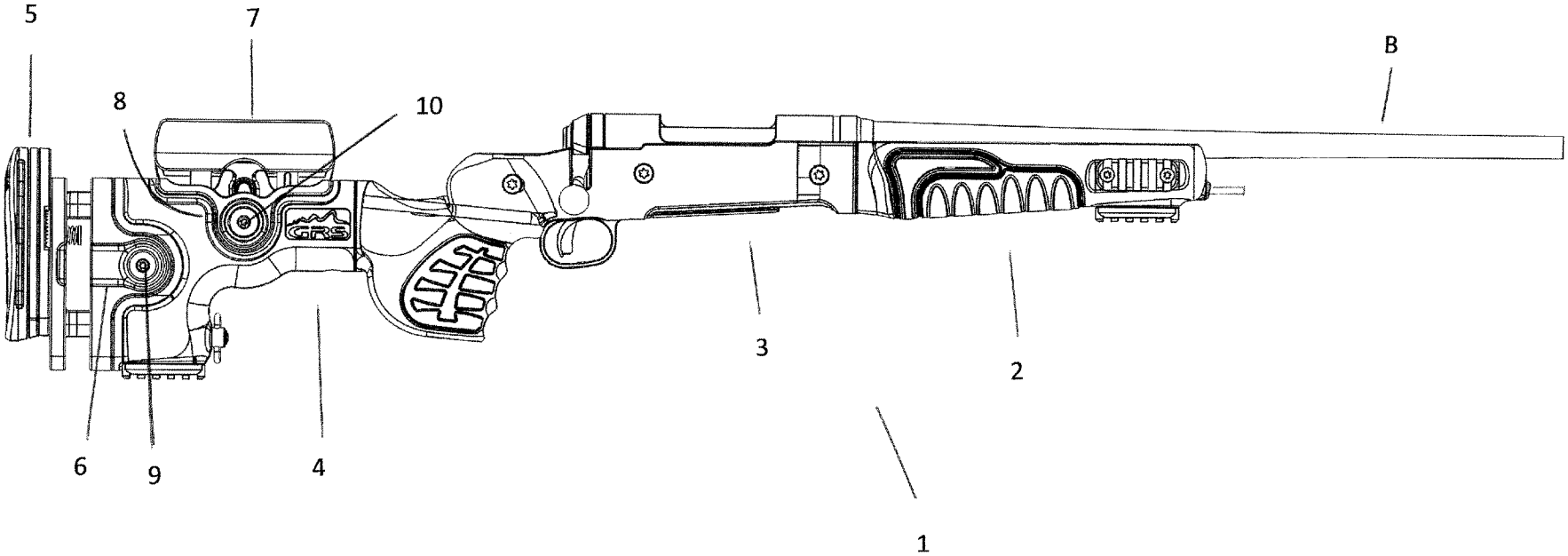

| | | | | |
|---|---|---|---|---|
| D736,336 | S * | 8/2015 | Mayberry | D22/108 |
| D760,326 | S * | 6/2016 | Chu | D21/573 |
| 9,664,476 | B1 * | 5/2017 | Robinson | F41C 23/14 |
| D804,602 | S * | 12/2017 | Barfoot | D22/108 |
| 9,915,498 | B1 * | 3/2018 | Spuhr | F41C 23/14 |
| D831,149 | S * | 10/2018 | Barfoot | D22/108 |
| 10,215,526 | B2 * | 2/2019 | Shinkle | F41C 23/08 |
| D883,419 | S * | 5/2020 | Windfeldt | D22/108 |
| 2002/0059747 | A1 * | 5/2002 | Weldle | F41C 23/14 42/72 |
| 2006/0254111 | A1 * | 11/2006 | Giauque | F41C 23/04 42/72 |
| 2007/0289190 | A1 | 12/2007 | Oz | |
| 2008/0028662 | A1 * | 2/2008 | Abraham | F41C 23/14 42/73 |
| 2009/0288324 | A1 * | 11/2009 | Peterson | F41A 11/02 42/75.03 |
| 2010/0307042 | A1 * | 12/2010 | Jarboe | F41A 3/18 42/6 |
| 2011/0173863 | A1 * | 7/2011 | Ingram | F41C 23/14 42/73 |
| 2014/0075815 | A1 | 3/2014 | Jarboe | |
| 2014/0196343 | A1 * | 7/2014 | Wilson | F41C 23/14 42/71.01 |
| 2014/0245649 | A1 * | 9/2014 | Fluhr | F41C 23/14 42/73 |
| 2015/0330728 | A1 * | 11/2015 | McGinty | F41A 3/84 89/198 |
| 2016/0202016 | A1 * | 7/2016 | Mather | F41C 23/14 42/73 |
| 2016/0209161 | A1 * | 7/2016 | Wilson | F41C 23/04 |
| 2017/0122698 | A1 * | 5/2017 | Chu | F41C 23/20 |
| 2017/0241737 | A1 * | 8/2017 | Keller, II | F41C 23/20 |
| 2018/0120055 | A1 * | 5/2018 | Silverman | F41C 23/04 |
| 2019/0056192 | A1 * | 2/2019 | Frazier | |
| 2020/0355462 | A1 * | 11/2020 | Inneci | F41C 23/20 |
| 2021/0048274 | A1 * | 2/2021 | Hopkins | F41C 23/14 |
| 2021/0116210 | A1 * | 4/2021 | Guillerm | F41C 23/20 |

OTHER PUBLICATIONS

Written Opinion issued in International Application No. PCT/EP2018/086210, dated Mar. 4, 2019 (8 pages).
International Preliminary Report on Patentability issued in Application No. PCT/EP2018/086210, dated Feb. 19, 2020 (16 pages).
Search Report issued in Norwegian Application No. 20172066, dated Jun. 29, 2018 (2 pages).

* cited by examiner

MODULAR STOCK FOR A FIREARM

The present invention relates to firearms in general. More particularly, the present invention relates to a modular, adjustable stock assembly for a firearm that incorporates a wide variety of adjustments to obtain a perfect fit either by the manufacturer, or by the owner in the field using adjustments integral with the stock itself.

Since the advent of shoulder-fired weaponry, such as guns, the use of a stock for holding the barrel and firing mechanisms of the weapon has been a standard practice. Typically, a stock made of wood, plastic, metal or combinations thereof extended rearward from the firing mechanism some finite distance creating the "gun butt" or "butt stock" portion. This butt stock portion was used to stabilize the weapon. The user would press the butt stock into his or her shoulder while taking aim and firing the weapon.

Standard rifles and other shoulder-fired weapons customarily have stocks with a butt portion located a particular distance from the trigger. That distance is termed "pull length" or "length of pull." The length of pull of most rifles is based on the arm length of a typical user. Problems may arise when the user's size varies from the typical user. With a smaller than typical user, the distance to the trigger is too great when the rifle is braced properly on the shoulder. Variation from correct fit results in increased likelihood of unsafe and inaccurate operation of the weapon.

Adjustable cheek rests on the butt stock of rifles and carbines assist the shooter in getting quickly and comfortably into proper sight alignment. Standard butt stocks do not account for different sizes and shapes of shooter physique, or different type aiming sights and scope mounts. An adjustable cheek rest allows the shooter to customize drop and eye relief adjustments such that when the shooter lays his cheek on the cheek rest, his dominant eye is automatically aligned with the sight system.

U.S. Pat. No. 8,720,099 B1 relates to a multi-axis adjustable buttstock that incorporates a buttstock, having, a grip neck, and a butt along with an interfaced set of two serrated grip retainers attached onto the buttstock grip neck, for buttstock tilt adjustment. A plurality of selectable flat and tapered grip spacers engage the grip serrated retainers for trigger grip length, cast and drop adjustment of the buttstock. A flanged stock bolt is disposed through a portion of the buttstock retaining the spacers and grip retainers while being embraced tightly by a first lock ring. A threaded rod is inserted into the buttstock a desired distance for length of pull adjustment and a second threaded lock ring is positioned on the threaded rod for securement. A recoil pad adapter plate, having a plurality of concentric holes, is attached to the threaded rod, for recoil pad slant adjustment, and a recoil pad is attached to the adapter plate aligned with selected recoil pad holes for recoil pad height and angle adjustments.

US 2007/0289190 A1 relates to an adjustable cheek rest for installation on the butt stock of a firearm, the cheek rest having an elongate comb adapted to conform to the top portion of the butt stock, the comb being supported on a rail that is fixed to, or removably mounted to, one side of the butt stock. The cheek rest comb is adjustable both longitudinally and vertically with respect to the butt stock to suit the needs of a particular shooter, the comb being attached to the butt stock by a fixture slidably engaging the rail to permit longitudinal adjustment and slidably engaging the comb to permit vertical adjustment. Once adjusted, the comb may be secured in a desired longitudinal and vertical location. A removable rail is also provided for mounting the cheek rest and/or other accessories to a firearm butt stock not having a fixed accessory mounting rail.

US 2014/0075815 A1 relates to an adjustable modular buttstock assembly. The buttstock assembly can include a frame with a central opening. A comb assembly having a cheek piece and a butt plate assembly having a recoil pad each can be mounted to the frame by an adjustment apparatus. Each adjustment apparatus can include of a guide post and/or a threaded adjustment post each received in respective bores in the frame to adjust the positions of the cheek piece and recoil pad. The adjustment apparatus also can include a locking or engagement feature that can selectively increase the friction between the frame and the guide post and/or adjustment post, to help prevent the translation of the guide post and/or adjustment post in the bore in the frame to fix the comb assembly and butt plate assembly in desired positions with respect to the frame.

An object of the present invention is therefore to provide a modular, adjustable stock assembly for a firearm, where the disadvantages of the prior art are eliminated or at least partially eliminated.

The present invention relates to firearms in general. More particularly, the present invention relates to a modular, adjustable stock assembly for a firearm that incorporates a wide variety of adjustments to obtain a perfect fit either by the manufacturer, or by the owner in the field using adjustments integral with the buttstock itself.

Yet another object of the present invention is to provide simple and easy adjustment mechanisms for the buttstock assembly, where the adjustment is easy to perform and where this adjustment does not result in that tools must be used.

These objects are achieved with a modular, adjustable stock assembly for a firearm according to the following independent claim, where further features of the invention appear from the dependent claims and the description below.

According to the present invention there is provided a stock for a firearm, where the stock may be a single piece stock or a modular stock. A modular stock may, for instance, comprise a foremost stock, an intermediate stock part and a buttstock including a pistol grip, where the different parts of the modular stock may be connected and locked together through a variety of different connecting and locking means. As a person skilled in the art will know how this can be done, this is not described any further herein. The stock may further comprise a butt plate mounted to the buttstock by a first adjustment device and may also comprise a cheek piece mounted to the buttstock by a second adjustment device. At least one of the first adjustment device or the second adjustment device may comprise a locking and releasing button, where the locking and releasing button is bilaterally operable, meaning that the locking and releasing button can be operated from both sides of the buttstock in order to adjust the butt plate or the cheek piece to the user of the firearm. However, it should be understood that each of the first and the second adjustment devices may comprise its own locking and releasing button that is bilaterally operable, whereby both the butt plate and the cheek piece may be operate from both sides of the firearm and adjusted independently of each other.

The butt plate may comprise a recoil pad adapter plate and a recoil pad.

Through the above arrangement, the butt plate can be extended and retracted, while the cheek piece lifted or lowered.

According to one embodiment of the present invention, the first adjustment device for the butt plate may further comprise two locking claws, a tension spring, a compression spring and a ball. Each of the locking claws may then, at one end of the locking claw, be provided with a throughgoing hole, such that the locking claws can be fixed to a housing by using locking screws, locking pins or the like. An opposite side of the locking claw may be provided with a plurality of teeth, where the distance between two adjacent or successive teeth, for instance, may be 2.5 mm, such that the butt plate may be adjusted in increments of 2.5 mm. The maximum length the butt plate may be adjusted relative the buttstock may for instance be 30 mm.

The locking claw may, on an opposite side of the plurality of teeth, be provided with a lug or the like towards an end of the locking claw, such that the two locking claws can be connected to each other through the tensioning spring, whereby the tensioning spring will, due to its stretched or tensioned state, try to bring the locking claws into contact with each other. Furthermore, the locking claw may be provided with a cam or the like on the same side as the lug, where the cam is arranged spaced apart from the lug. In one embodiment, the cam may be located towards the middle of the locking claw, for instance at half of a length of the locking claw.

The locking and releasing button of the first adjustment device has preferably a circular cross-section over its length, where the cross-section will vary over the length of the locking and releasing button, from a first diameter to a second diameter and then again to a first diameter. In an aspect of the invention the first diameter is smaller than the second diameter. Furthermore, each end of the locking and releasing button is provided with a button. Each of the buttons of the first adjustment device may then be used to push the first adjustment device from a locked state to a released state, in which released state the butt plate can be adjusted.

A part of the locking and releasing button of the first adjustment device is cut off, such that the locking and releasing button over a part of its length will have a plane surface, where a cavity or hollow is provided in the plane surface.

The butt plate comprises two spaced apart guiding elements, where each guiding element, on a surface facing the other guiding element, is provided with a plurality of teeth. The plurality of teeth provided on each guiding element will have a corresponding form as the teeth provided on the locking claws, whereby the plurality of teeth provided on the guiding elements and the locking claws will cooperate to lock the butt plate to the buttstock. The length of the plurality of teeth provided on each of the guiding elements may, for instance, be 30 mm.

The guiding elements have preferably a U-shaped form, but it should be understood that the guiding elements also could have other form, such as quadratic or rectangular form. Furthermore, the guiding elements could be hollow or solid.

At least one of the guiding elements may, on an opposite side of the plurality of teeth, be provided with a recess, where a pin or a bolt is to be received in the recess in order to prevent that the butt plate can be removed completely from the buttstock when the first locking and releasing device is in an unlocked or released state. The pin or bolt may then in appropriate ways be fixed to the housing of the first adjustment device or also to the buttstock. As is to be understood, the pin or bolt may be removed from the housing or the buttstock, whereby this will allow the butt piece to be completely removed from the buttstock.

The second adjustment device that is used to adjust the cheek piece of the buttstock, may comprise a regulation element that is to be attached and fixed to the cheek piece. The regulation element and the cheek piece may be attached and fixed to each other through appropriate fastening means, such as screws, bolts, snap connections or the like. A person skilled in the art will know how this can be done, whereby this is not described any further herein. Furthermore, one or more spacer elements may be arranged between the regulation element and the cheek piece in order to extend the height the cheek piece can obtain. The spacer elements may have different thickness.

The regulation element may comprise two spaced apart guiding rods and two spaced apart locking elements, where one guiding rod may be arranged towards each end of the regulation element, and the locking elements may be arranged between the guiding rods. Furthermore, each of the two locking elements may be provided with a plurality of teeth on a surface facing the other locking element, where the plurality of teeth is provided over a part of a length of the locking elements.

The guiding rods may be, in order to save weight, hollow, but it should be understood that the guiding elements also could be solid.

At least one of the guiding rods is provided with a through-going longitudinal slot extending over a part of a length of the guiding rod, where this through-going longitudinal slot will receive and accommodate a pin or a bolt in order to prevent the cheek piece to be removed completely from the buttstock when the second locking and releasing device is in an unlocked or released state, for instance when the cheek piece is to be adjusted to the user. The pin or bolt may then in appropriate ways be fixed to the housing of the second adjustment device or also to the buttstock. As is to be understood, the pin or bolt may be removed from the housing or the buttstock, whereby this will allow the cheek piece to be completely removed from the buttstock.

The locking and releasing button of the second adjustment device comprises a first part and a second part, where one end of the first part is in the form of a button. A solid part will extend out from the button, where the solid part has a rectangular form with a thickness T, a length L and a height H. Furthermore, the first part is provided with a plurality of teeth on opposite sides of the solid part, where these teeth will have a form to cooperate with the plurality of teeth provided on the locking elements. An aperture is furthermore provided between the plurality of teeth, where the aperture will extend a length into the solid part and being of such a size that it can receive and accommodate a spring and a ball. The plurality of teeth and the aperture will be arranged to extend perpendicular to the longitudinal direction of the first part.

On an opposite side of the button, the solid part may be provided with at least one projection and a throughgoing hole, where the at least one projection and the throughgoing hole will extend in the longitudinal direction of the first part.

Similarly, one end of the second part of the locking and releasing button of the second adjustment device is in the form of a button, where a solid part extends out from the button. An end of the solid part, on an opposite side of the button, is provided with at least one groove or notch and a throughgoing hole, where the at least one groove or notch will extend in the longitudinal direction of the second part. When the first and second part of the locking and releasing button of the second adjustment device are assembled, the at least one projection of the first part will be accommodated in the at least one groove or notch of the second part. A bolt, screw or the like is then used to lock the two parts to each other.

Other advantages and features of the present invention will become apparent from the following detailed description, the accompanying figures and the appended claims.

Figure 1B:
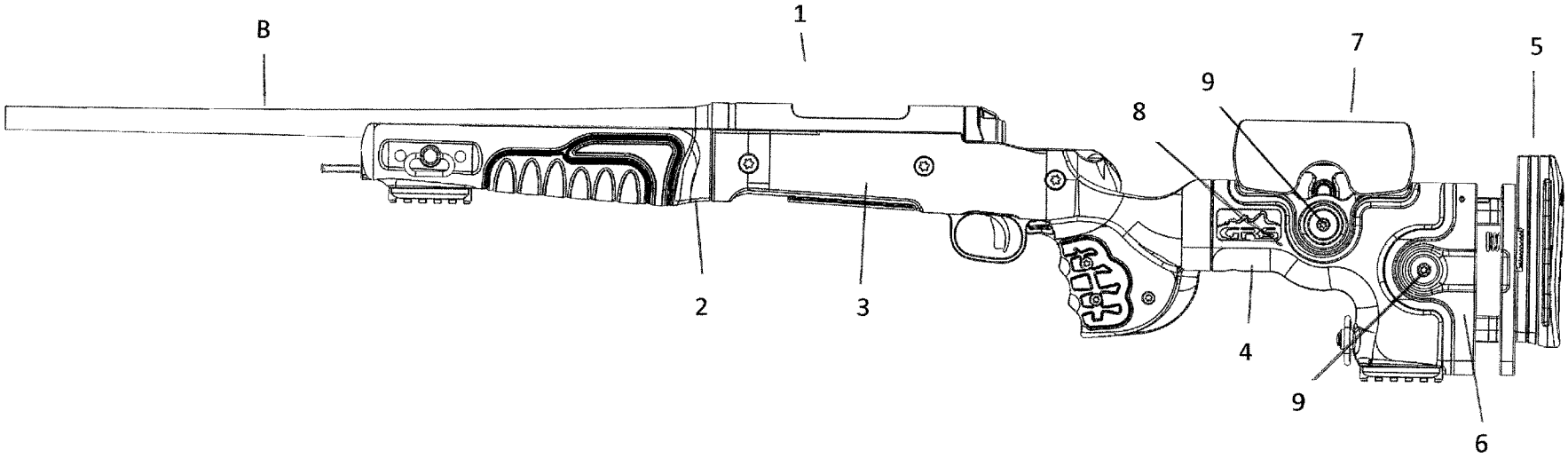
Figure 1C:
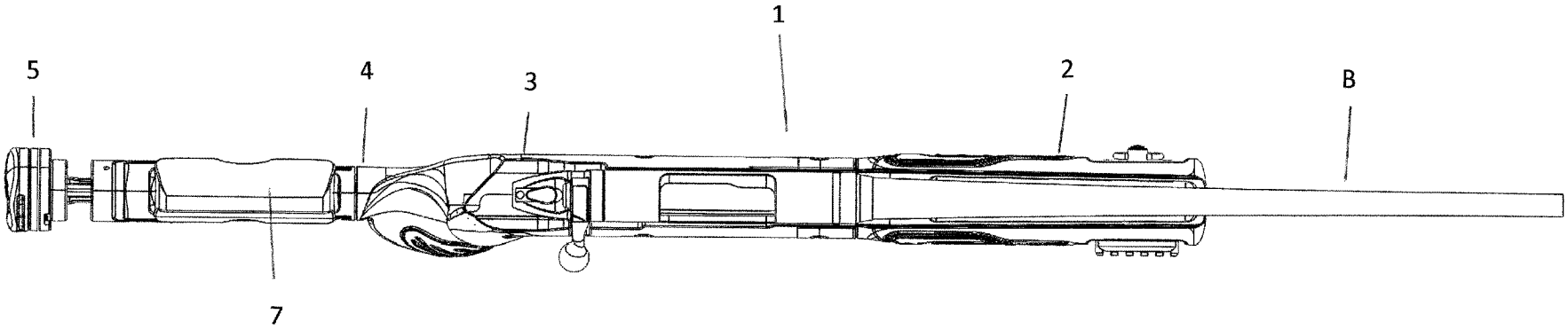
Figure 2A:
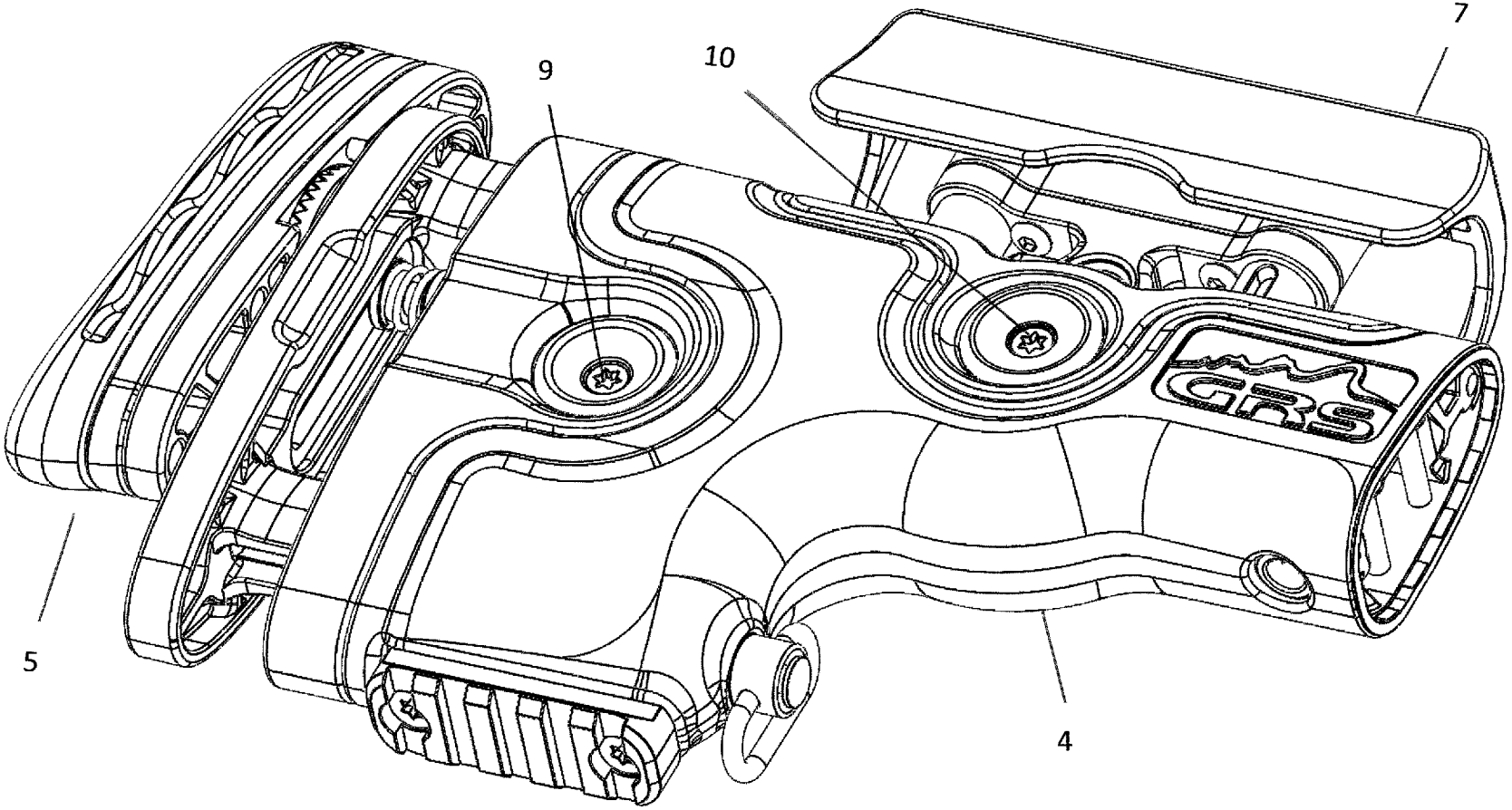
Figure 2B:
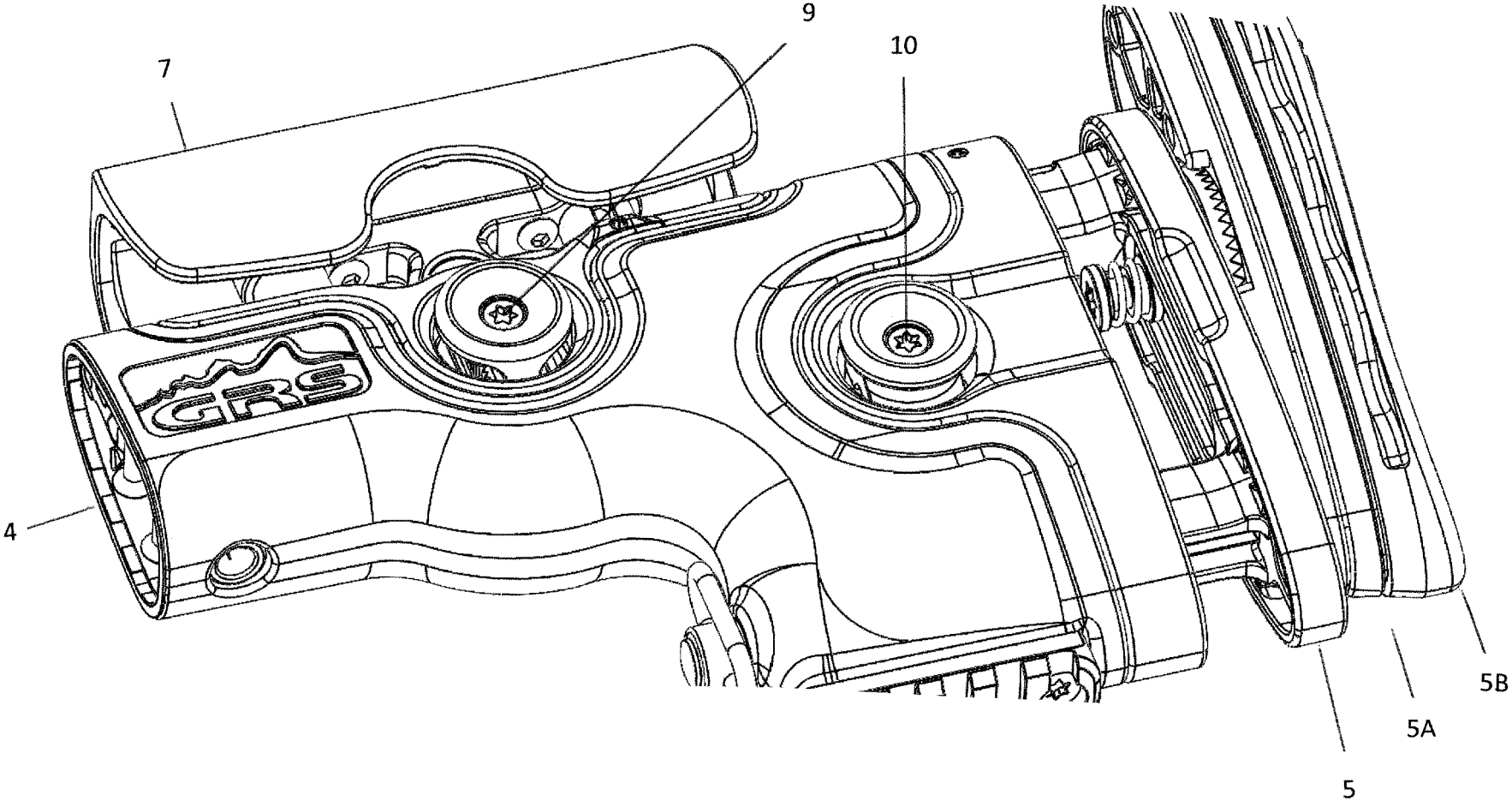
Figure 3A:
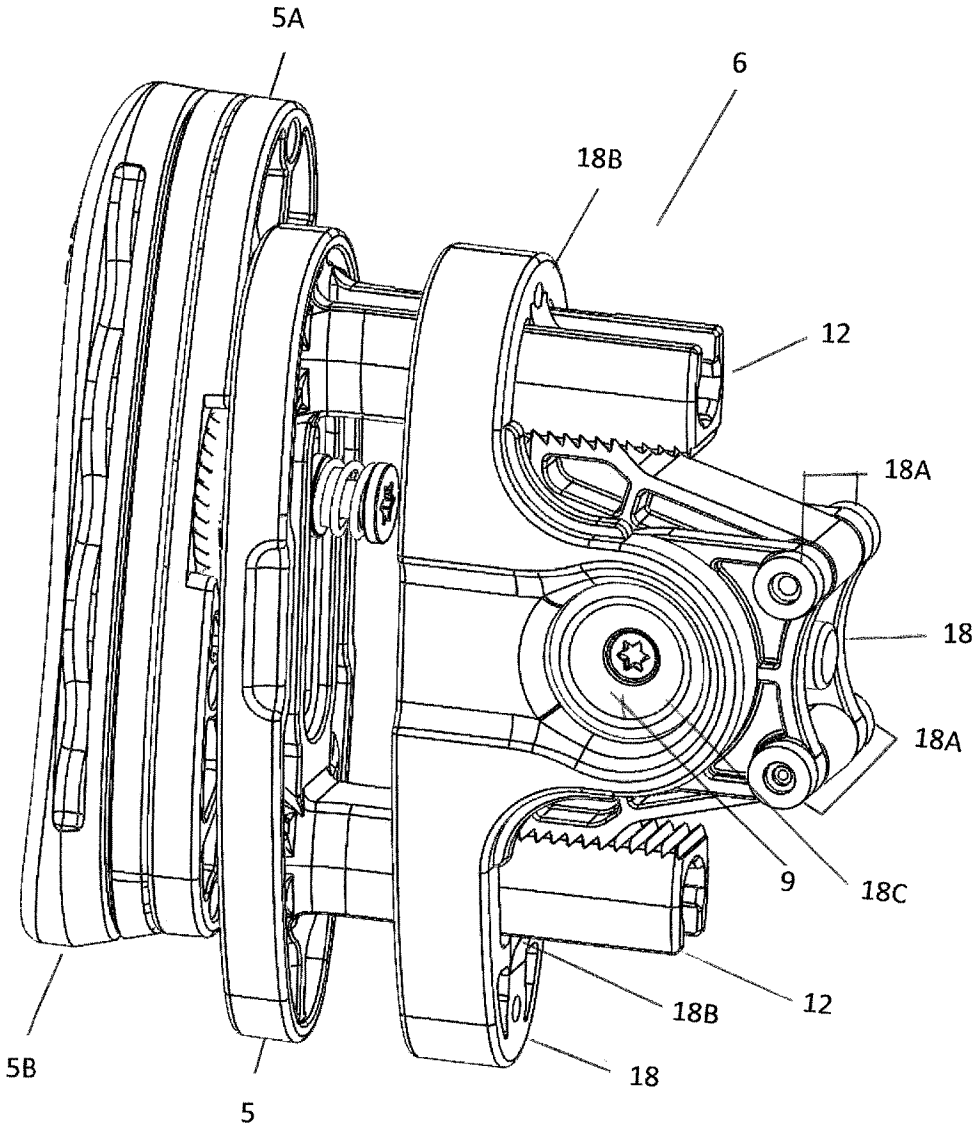
Figure 3B:
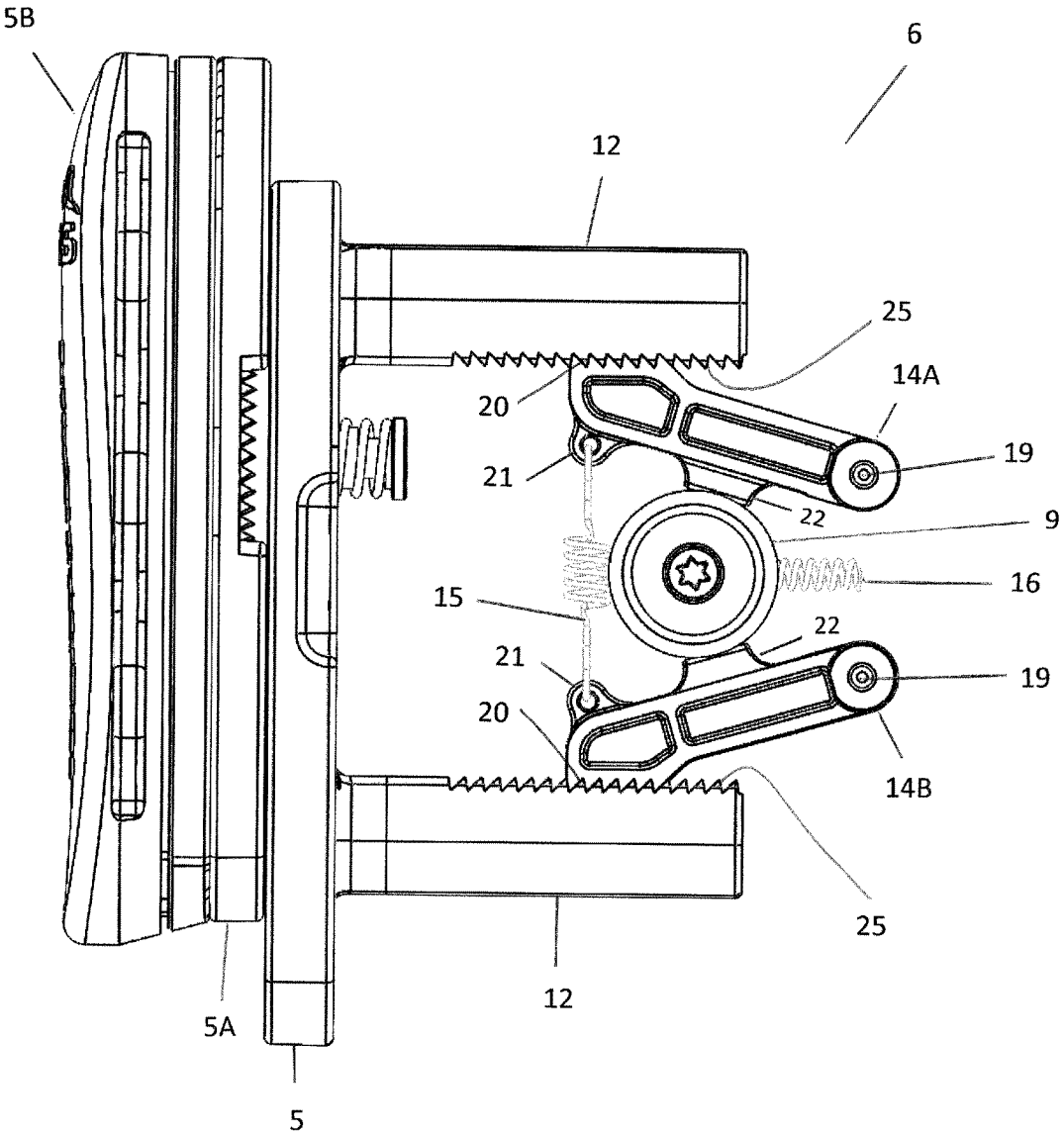
Figure 3C:
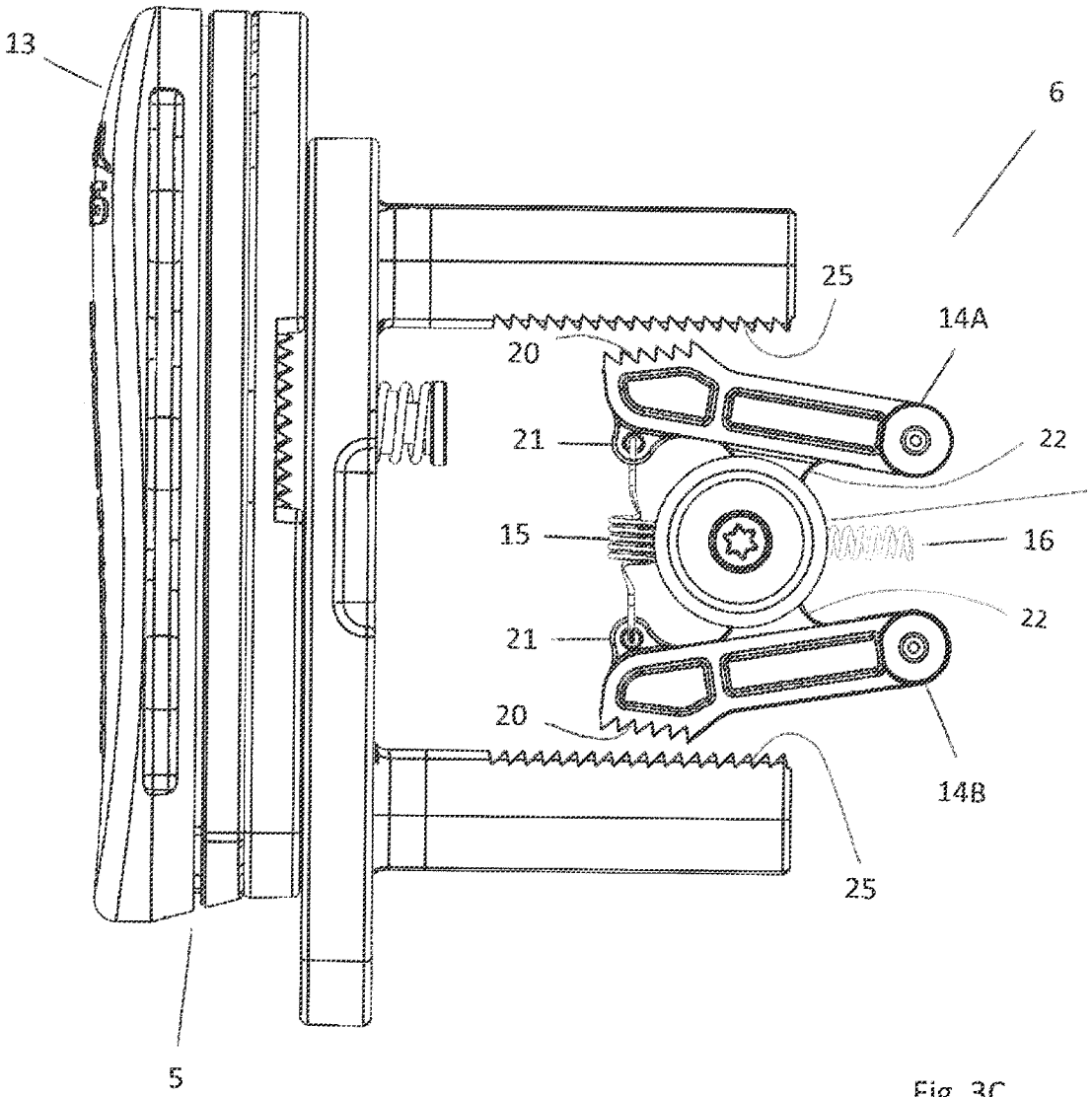
Figure 3D:
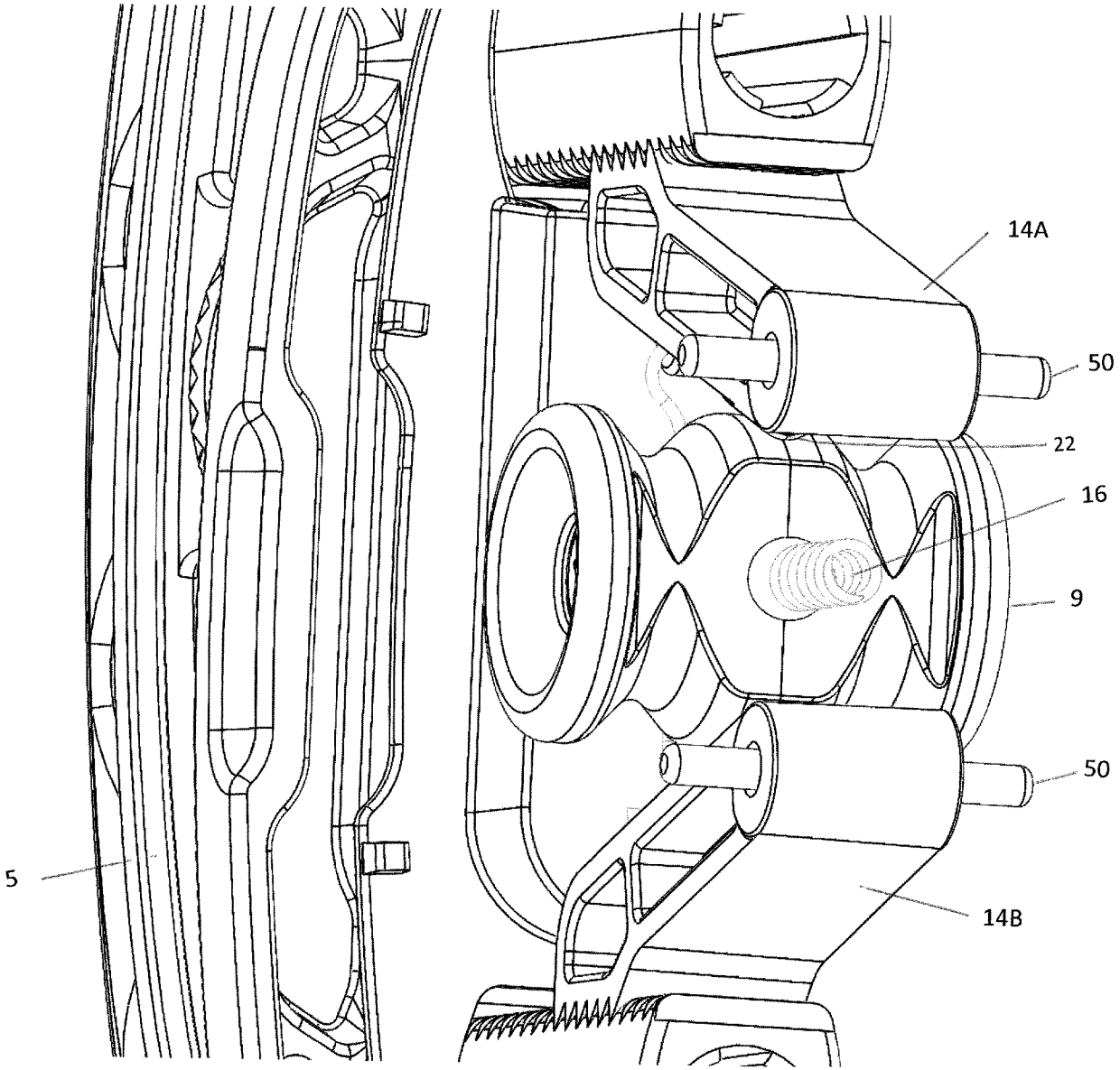
Figure 3E:
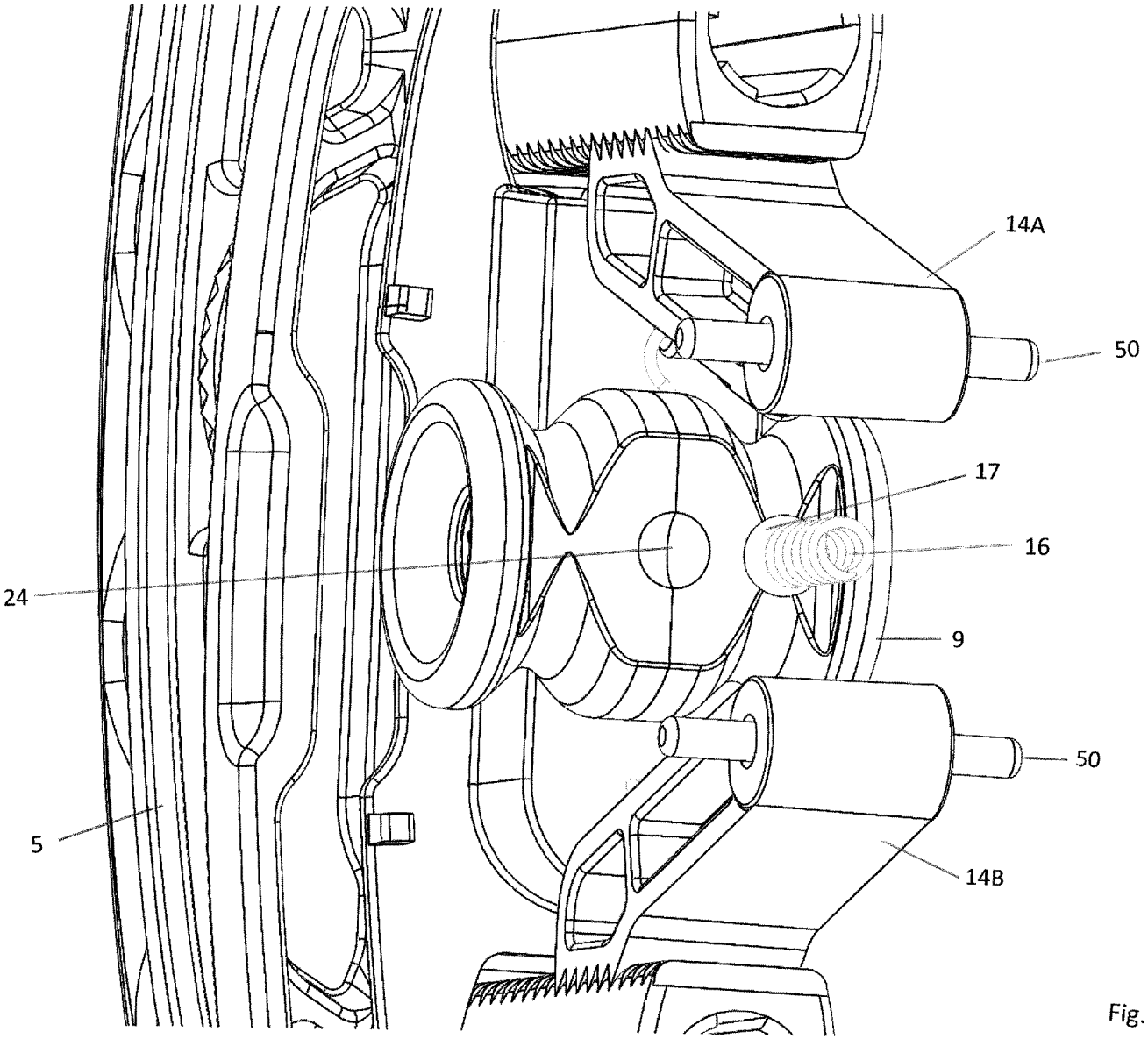
Figure 3F:
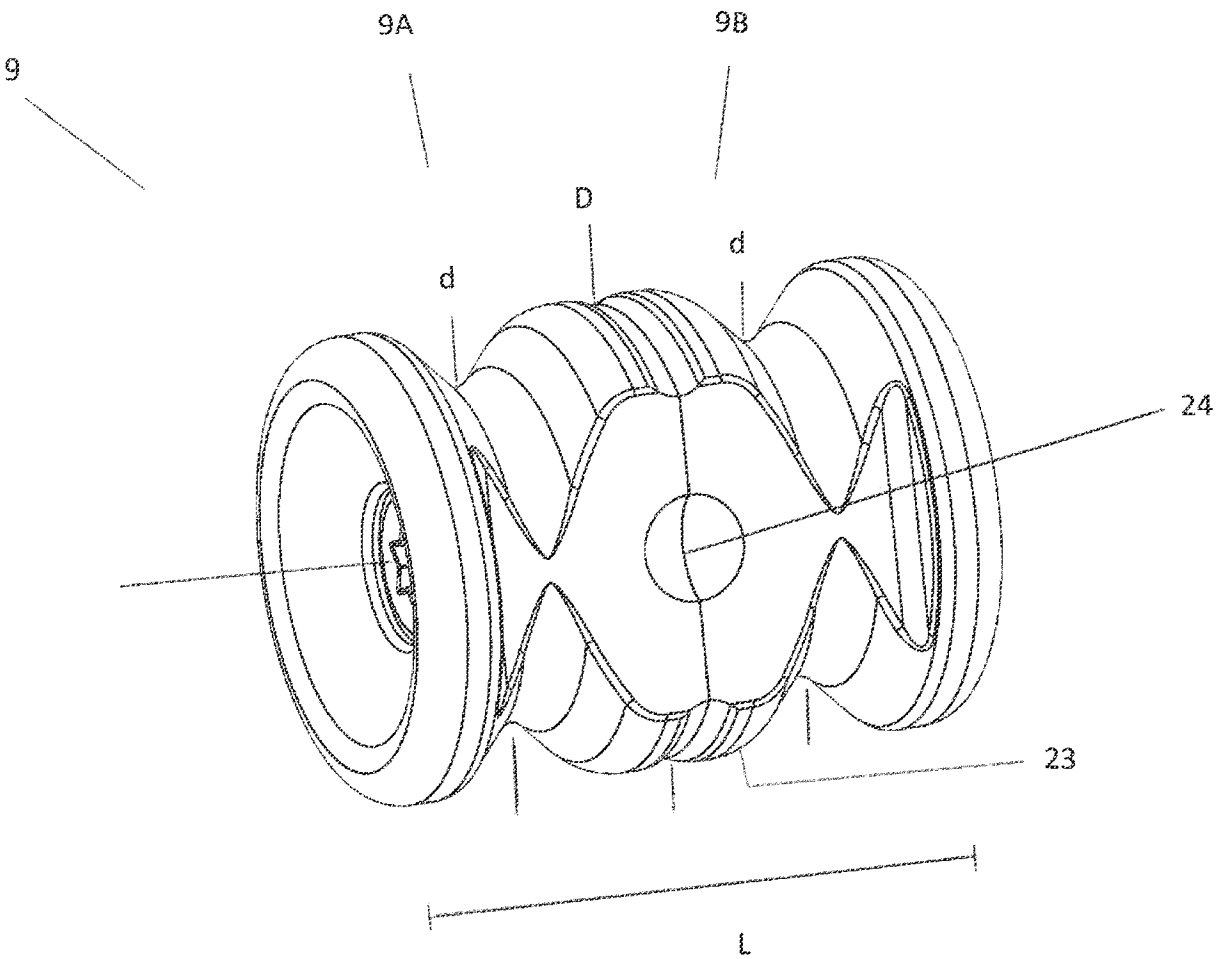
Figure 3G:
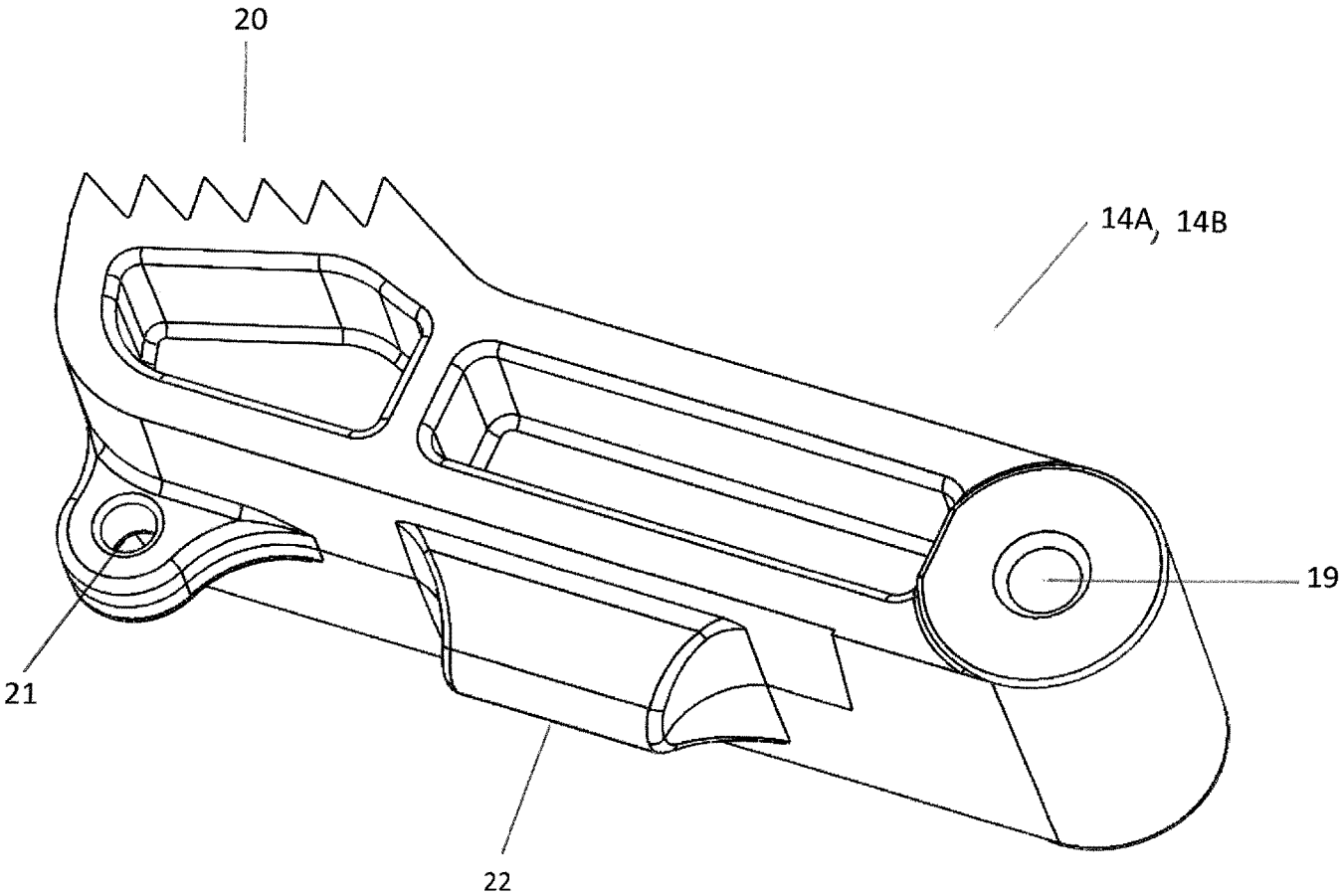
Figure 4A:
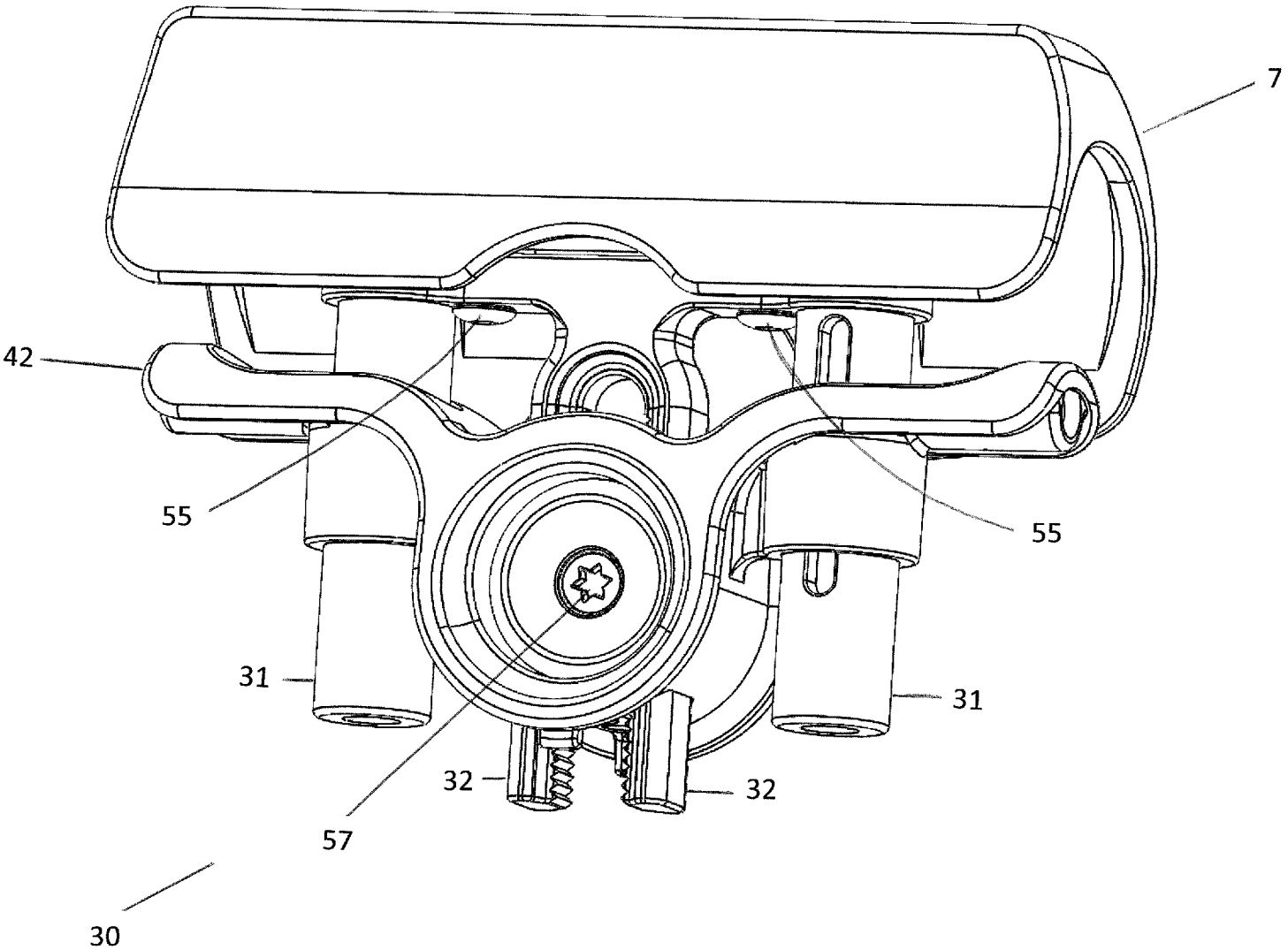
Figure 4B:
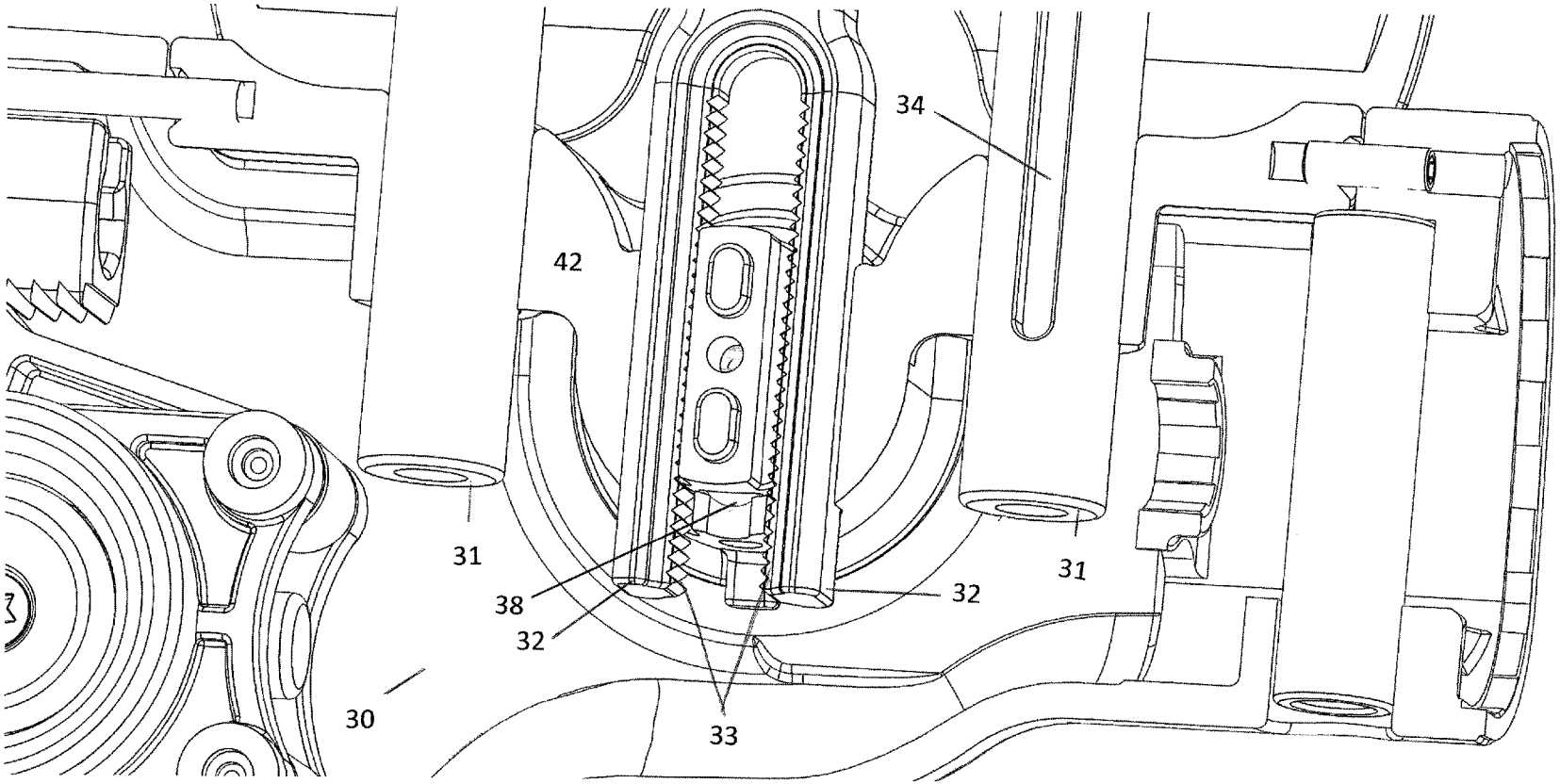
Figure 4C:
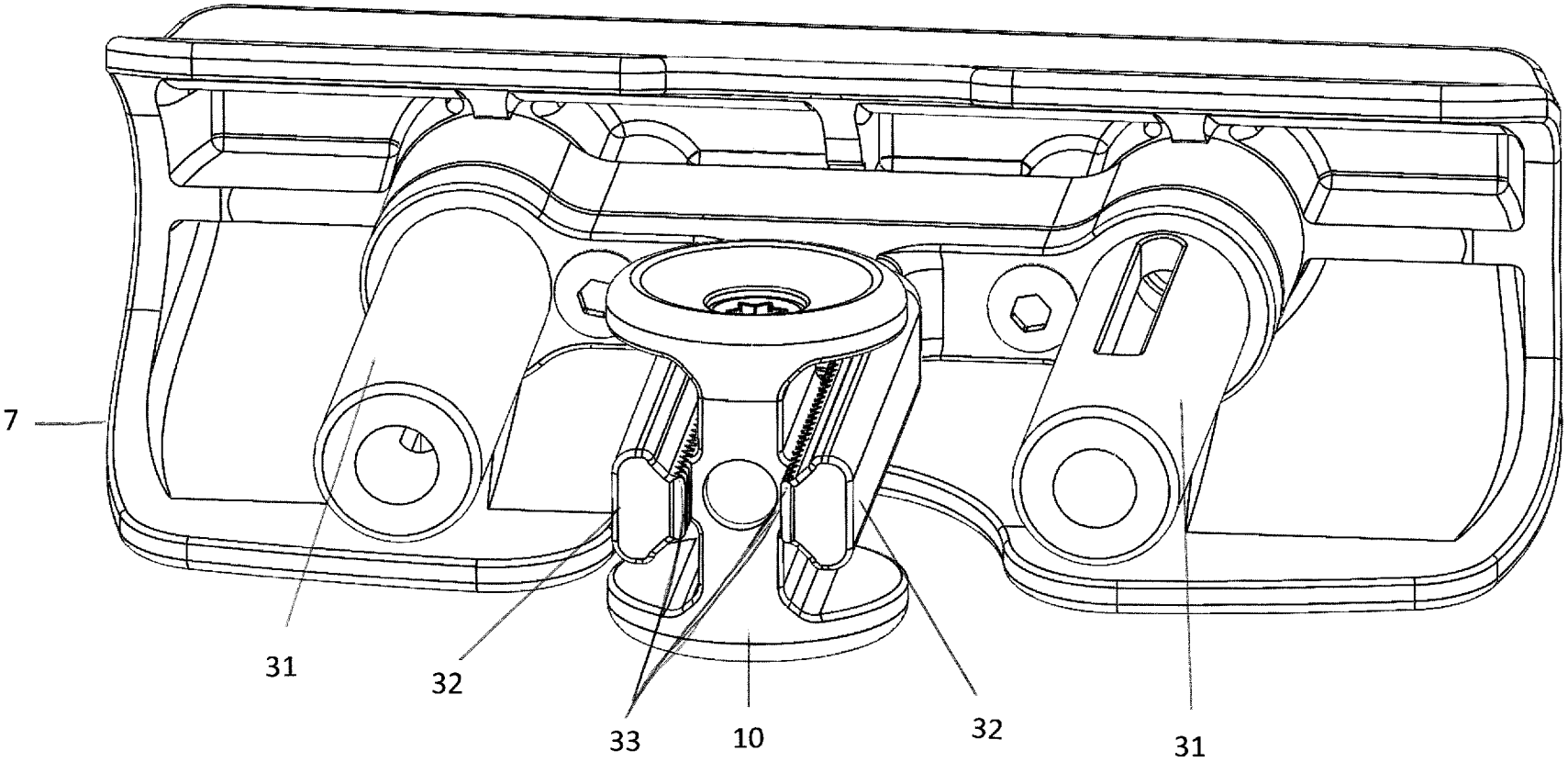
Figure 4D:
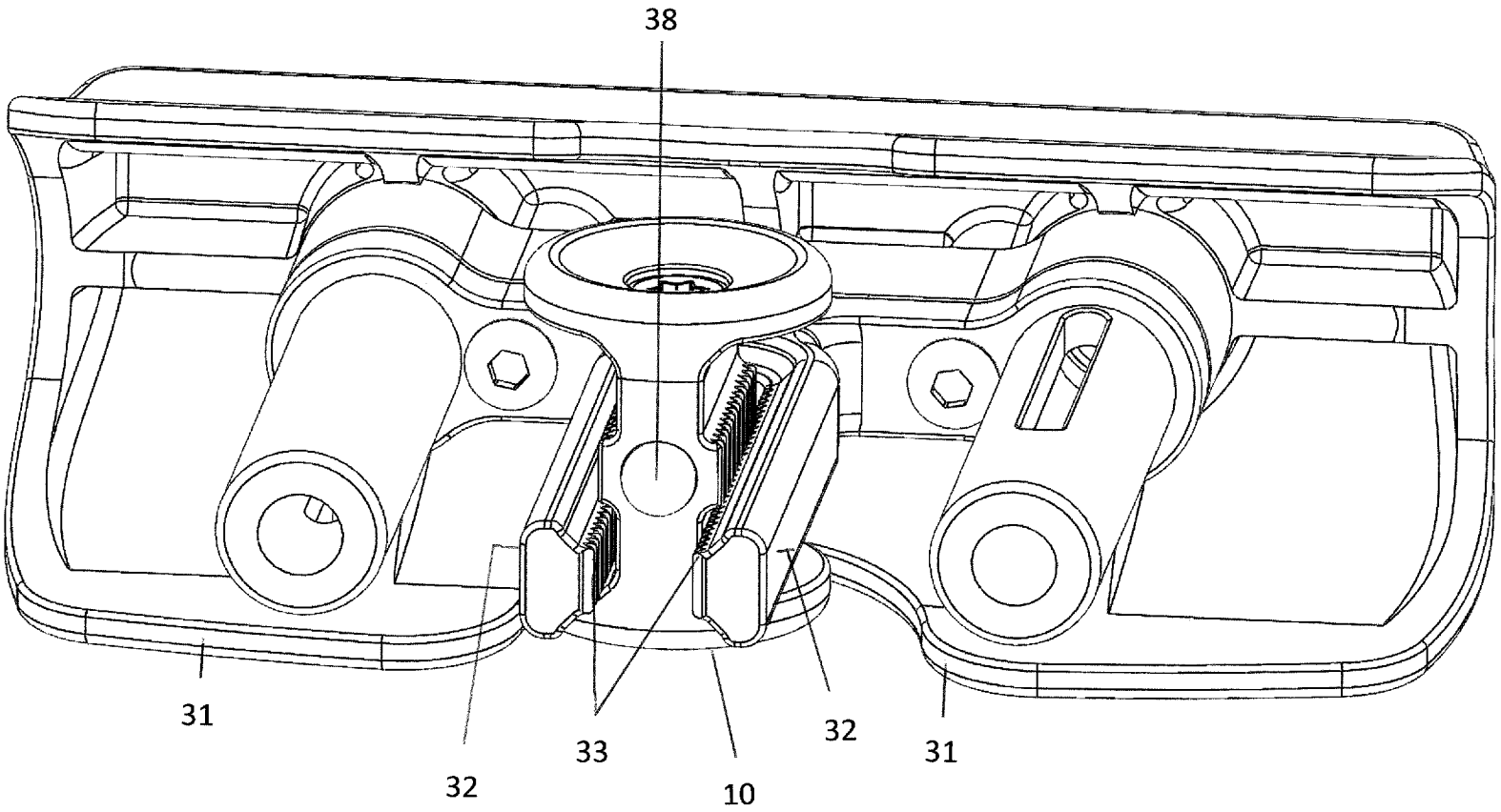
Figure 4E:
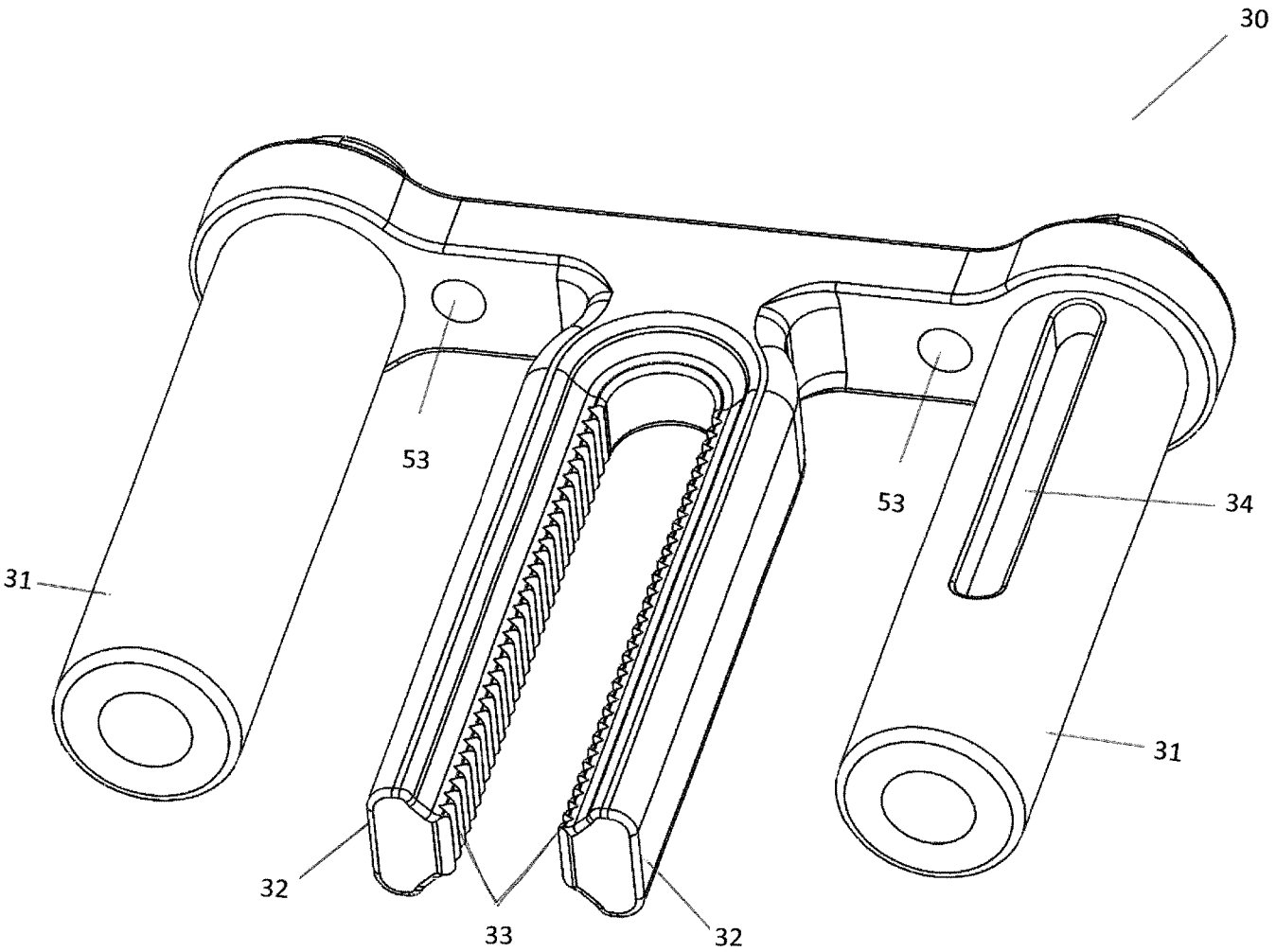
Figure 4F:
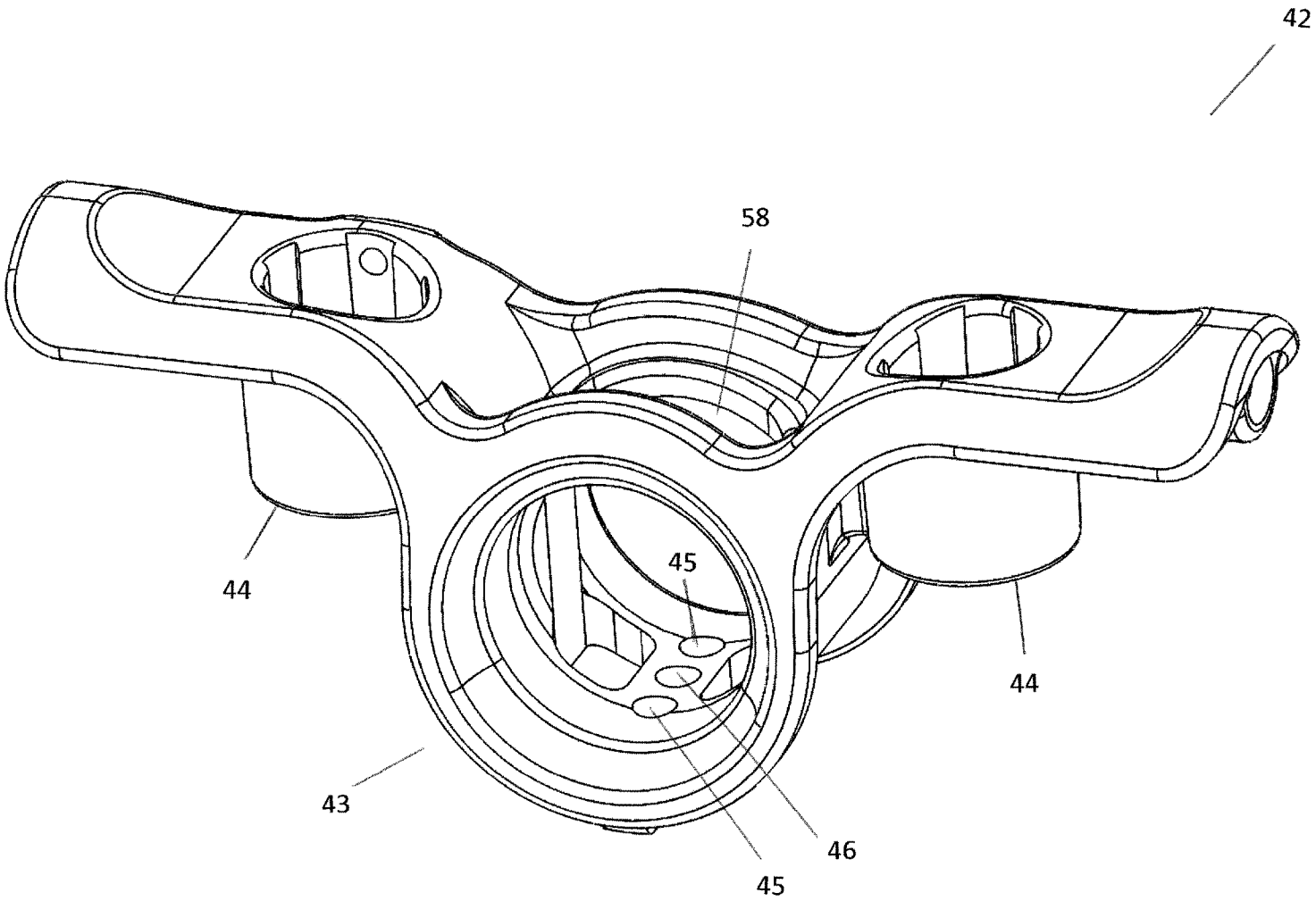
Figure 4G:
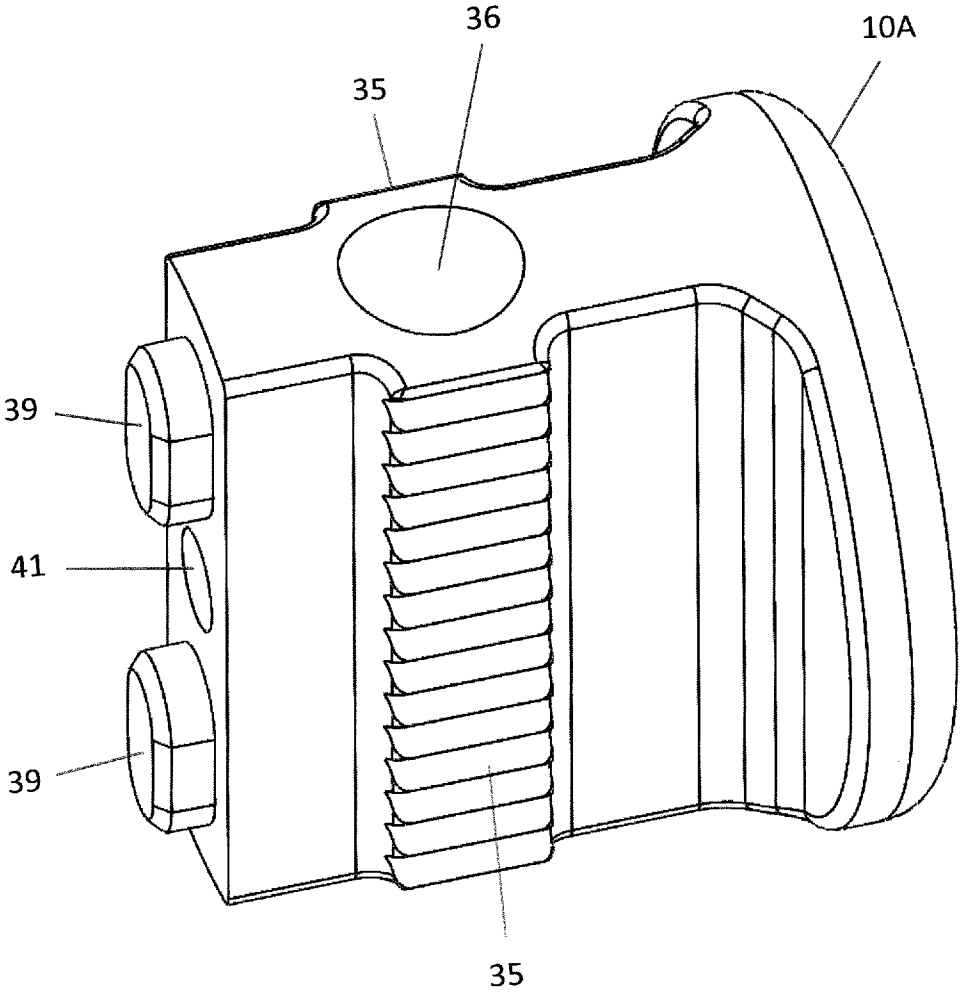
Figure 4H:
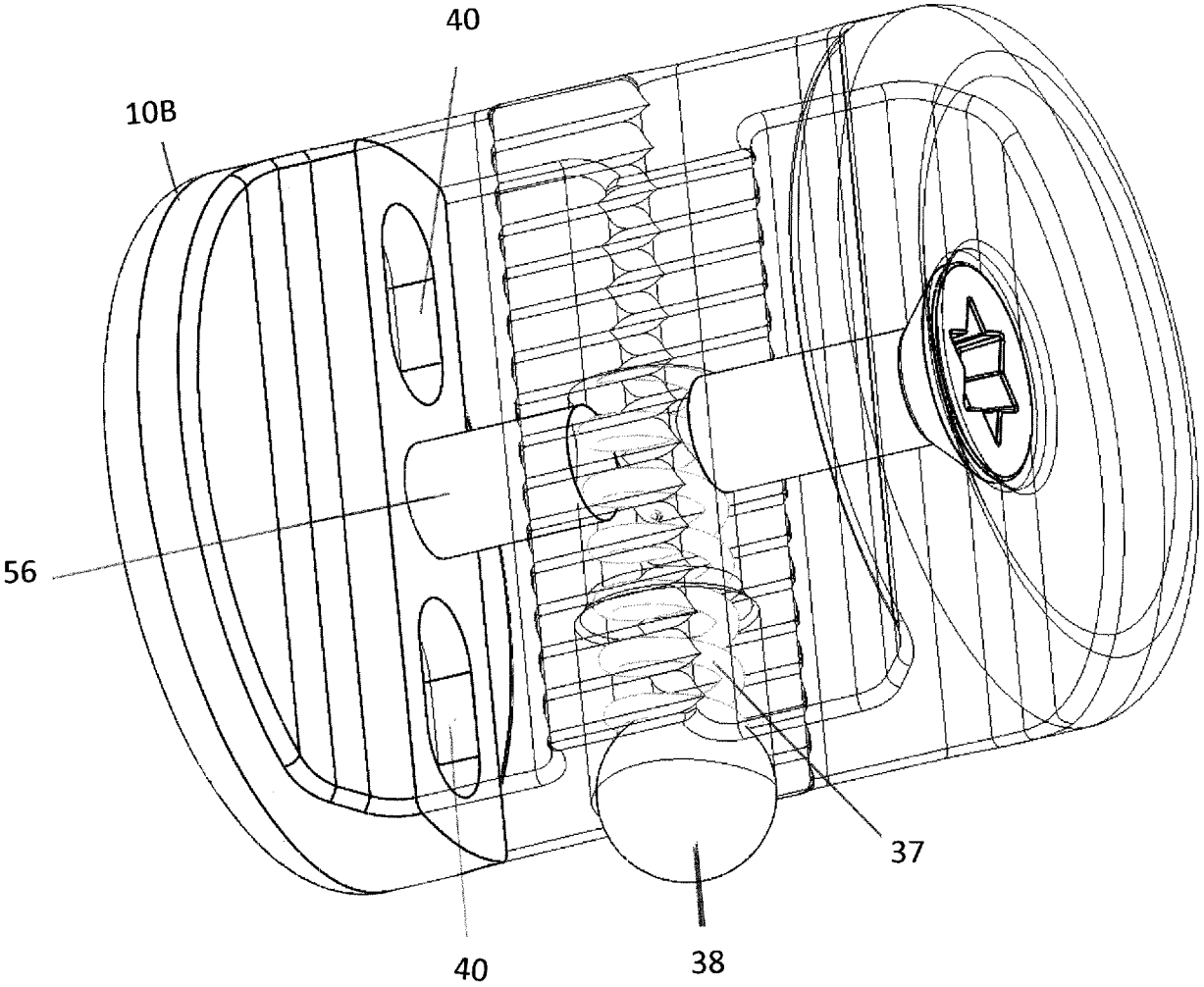
Figure 4I:
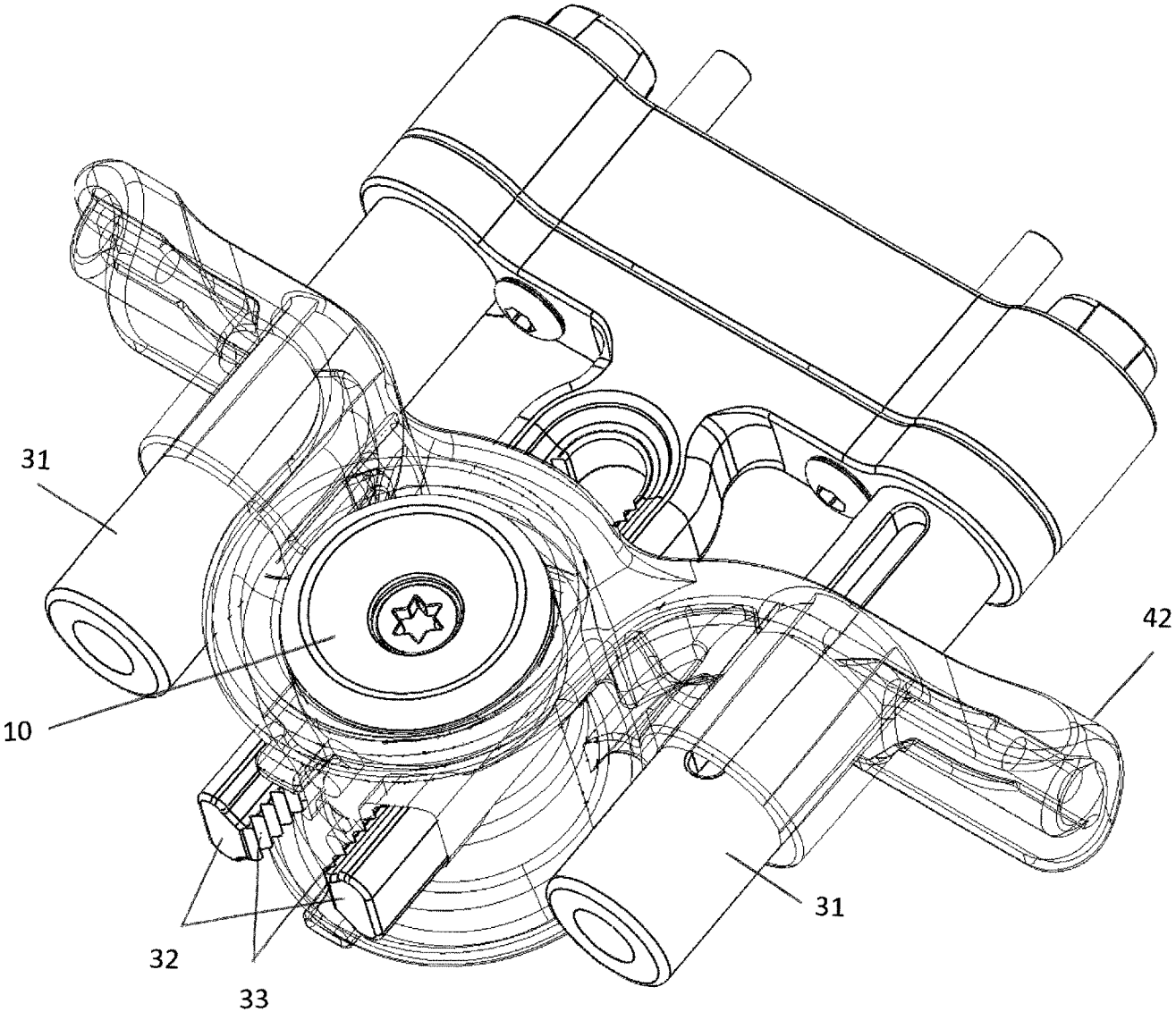

The invention will now be described with reference to the following figures, in which:

FIGS. 1A-1C show a modular stock for a firearm according to the present invention, where FIG. 1A shows the modular stock from a side, FIG. 1B shows the modular stock from an opposite side and FIG. 1C shows the modular stock from above, FIGS. 2A-2B show a buttstock of the modular stock, where FIG. 2A shows the buttstock from a right side, and FIG. 2B shows the buttstock from a left side, FIGS. 3A-3G show details of a first adjustment device for a butt plate mounted to the buttstock of the modular stock, where FIG. 3A shows the first adjustment device arranged in an housing, FIG. 3B shows the first adjustment device in a locked position, FIG. 3C shows the first adjustment device in a released position, FIG. 3D shows in greater detail a locking and releasing button of the first adjustment device in a locked state, FIG. 3E shows in greater detail the locking and releasing button of the first adjustment device in a released state, FIG. 3F show in greater detail the locking and releasing button of the first adjustment device, and FIG. 3G shows in greater detail a locking claw of the first adjustment device, FIGS. 4A-4I show details of a second adjustment device for a cheek piece mounted to the buttstock of the modular stock, where FIG. 4A shows the second adjustment device arranged in a housing, FIGS. 4B and 4C show the second adjustment device in a locked position, in a perspective view from above and from a side, FIG. 4D shows the second adjustment device in a released position, FIG. 4E shows in greater detail a regulation element which is to be mounted to the cheek piece, FIG. 4F shows a housing in which the second adjustment device is mounted into, FIGS. 4G and 4H show in greater detail a locking and releasing button of the second adjustment device and FIG. 4I shows an assembled second adjustment device, and FIGS. 5A-5F show an adjustment device for a butt plate mounted to the modular stock, where the butt plate can be adjusted in height and/or angle relative the buttstock.

FIGS. 1A-1C show a gunstock 1 for a firearm according to the present invention from a right side (FIG. 1A), from a left side (FIG. 1B) and from above (FIG. 1C). A barrel B is either permanently fixed or releasably arranged in the gunstock 1.

FIGS. 1A-1C show a gunstock 1 for a firearm according to the present invention, where the gunstock 1 is modular and comprises a foremost part 2, an intermediate part 3 and a buttstock 4. In order to allow the owner or the user of the firearm to customize the firearm, the gunstock 1 comprises a butt plate 5, where the butt plate 5 through a first adjustment device 6 is mounted to the buttstock 4, such that the butt plate 5 can be extended and retracted relative the buttstock 4, thereby prolonging or shortening an overall length of the firearm. The gunstock 1 also comprises a cheek piece 7, where also the cheek piece 7 can be adjusted through a second adjustment device 8. The cheek piece 7 is mounted to the buttstock 4 through the second adjustment device 8. The cheek piece 7 can, through the second adjustment device 8, be lifted up or raised from the buttstock 4, or lowered relative the buttstock 4.

Furthermore, the butt plate 5 comprises a recoil pad adapter plate 5A and a recoil pad 5B, where the recoil pad 5B can be height and/or angle adjusted relative the recoil pad adapter plate 5A.

The foremost part 2, the intermediate part 3 and the buttstock 4 may be connected and locked to each other through a variety of different connecting and locking means, such as screws, bolts and nuts, fast connecting means, A person skilled in the art would know how this can be done whereby this is not described any further herein.

FIGS. 2A-2B show the buttstock, the butt plate 5 and the cheek piece 7 from a right side (FIG. 2A) and a left side (FIG. 2B), where it can be seen that the buttstock 4 is designed identical on both sides. Both the butt plate 5 and the cheek piece 7 are shown in a state where they can be adjusted, as the first and second adjustment devices 6, 8 are brought into an unlocked or released state.

FIGS. 3A-3G show the first adjustment device 6 according to the present invention, where the first adjustment device 6 is used to adjust the butt plate 5 relative the buttstock 4. The buttstock 4 is omitted in order to explain and understand the cooperation between the different elements of the first adjustment device 6 and the butt plate 5.

FIG. 3A shows the first adjustment device 6 arranged in a housing 18, where the housing 18 is arranged in the buttstock 4 when the gunstock 1 is completely assembled. The buttstock 4 is hollow, such that the housing 18 can be pushed into the buttstock 4. The housing 18 can be fixed to the buttstock 4 through appropriate fastening means (not shown). The butt plate 5 can then be locked and released from the housing 18.

The first adjustment device 6 comprises two locking claws 14A, 14B, a tension spring 15, a compression spring 16, a ball 17 and a first locking and releasing button 9.

FIG. 3B shows the first adjustment device 6 in a locked state, whereby the butt plate 5 is locked to the housing 18, such that the butt plate 5 cannot be adjusted relative the buttstock 4. The first adjustment device 6 comprises two locking claws 14A, 14B, where each of the locking claws 14A, 14B at one end is provided with a throughgoing hole 19 and at an opposite end is provided with a plurality of teeth 20, see also FIG. 3G.

The locking claws 14A, 14B will be fixed to the housing 18 through a pin 50 (see FIGS. 3D and 3E), bolt or the like, whereby the throughgoing hole 19 will function as a pivot point for the locking claws 14A, 14B. The housing 18 is then provided with two throughgoing openings 18A for reception of the pin, bolt or the like.

Furthermore, each of the locking claws 14A, 14B is, on an opposite side of the plurality of teeth 20, provided with a lug 21 and a cam 22.

When the first adjustment device 6 is arranged and fixed in the housing 18, the locking claws 14A, 14B are arranged such that the plurality of teeth 20 of the locking claws 14A, 14B will face away from another, while the lugs 21 and cams 22 of the locking claws 14A, 14B will face each other.

The compression spring 16 is connected to each of the lugs 21 of the locking claws 14A, 14B, where the compression spring 16 will try to pull the lugs 21 and thereby also the locking claws 14A, 14B towards each other.

The butt plate 5 comprises two spaced apart guiding elements 12, where the guiding elements have a substantially U-shaped form. Furthermore, each guiding element 12 is, on a surface facing the other guiding element 12, provided with a plane surface over a part of its length, where the plane surface is provided with a plurality of teeth 25. The housing 18 is then provided with two throughgoing openings 18B for reception of the guiding elements 12, and a through-going opening 18C for reception of the locking and releasing button 9.

When the first adjustment device 6 is in a locked state, the plurality of teeth 20 are brought into contact with corresponding teeth 25 provided on the guiding elements 12 of the butt plate 5. Due to a position of the locking and releasing button 9, the locking claws 14A, 14B are prevented to move relative each other.

In FIG. 3C the first adjustment device 6 is shown in an unlocked or released state, where the locking and releasing button 9 has been moved transversely relative the buttstock 4 to a position where the compression spring 16 has moved the locking claws 14A, 14B towards each other, such that the plurality of teeth 20 of the locking claws 14A, 14B has been brought out of abutment with the plurality of teeth 25 of the guiding elements 12 of the butt plate 5. The butt plate 5 is now free to move relative the housing 18 or the buttstock 4.

FIG. 3D shows the position of the locking and releasing button 9 in a locked state of the first adjustment device 6 and FIG. 3E shows the position of the locking and releasing button 9 in an unlocked or released state of the first adjustment device 6.

FIG. 3F shows the locking and releasing button 9 of the first adjustment device 6 in greater detail, where it is seen that the locking and releasing button 9 comprises a first part 9A and a second part 9B, where the first and second part 9A, 9B are connected to each other through a screw 9C, bolt or the like and a nut (not shown). The first and second part 9A, 9B are identical in their form. Each of the first and second part 9A, 9B comprises a button and a part with varying cross-section, where this will provide a first area in the locking and releasing button 9 having a first diameter d, and a second area in the locking and releasing button 9 having a second diameter D. The first diameter d is smaller than the second diameter D. Furthermore, each area of the first and second diameters d, D is rounded, thereby forming a groove or notch around a part of a circumference of the locking and releasing button 9.

Each of the first and second part 9A, 9B is provided with a plane surface, where a cavity or hollow 24 is provided in the plane surface.

It is now referred once again to FIGS. 3D and 3E in order to explain the locked and released state of the first adjustment device 6. In FIG. 3D is shown the position of the locking and releasing button 9 in a locked state, where the locking and releasing button 9 is arranged in a position where the compression spring 16 has pushed the ball 17 into the cavity or hollow 24. The housing 18 is then provided with a sunken area (not shown in the figures) on its inside, such that it can receive an end opposite the ball 17. In this position the cams 22 of the locking claws 14A, 14B will be in abutment with the groove or notch formed in the area of the second diameter D, whereby the size of the second diameter D will not allow the tension spring 15 to move the locking claws 14A, 14B towards each other and the first adjustment device 6 will therefore be in the locked state, as also shown in FIG. 3B.

In FIG. 3E is shown the position of the locking and releasing button 9 in an unlocked or released state, where the locking and releasing button 9 is pushed transversely relative the buttstock 4. Through this movement of the locking and releasing button 9, the ball 17 has been pushed out of the abutment with the cavity or hollow 24, where this has compressed the compression spring 16. The ball 17 and the cams 22 of the locking claws 14A, 14B will then be pushed into the groove or notch formed in the area of the first diameter d. As the first diameter d is smaller than the second diameter D, this will result in that the tension spring 15 will move the locking claws 14A, 14B towards each other, whereby this will bring the plurality of teeth 20 of the locking claws 14A, 14B out of abutment with the plurality of teeth 25 provided on the guiding elements 12, and the butt plate 5 can be adjusted relative the buttstock 4, as also shown in FIG. 3C.

Once the butt plate 5 is adjusted, the locking and releasing button 9 will be pushed back again, such that the ball 17 can be pushed back into the cavity or hollow 24 again.

In FIG. 3E the locking and releasing button 9 has been pushed towards the left side of the figure, but the locking and releasing button 9 could also have been pushed towards the right side of the figure, whereby the ball 17 and the cams 22 of the locking claws 14A, 14B would have been pushed into the groove or notch formed in the area of the first diameter d on the opposite side of the cavity or hollow 24, whereby the locking and releasing button 9 of the first adjustment device 6 could be operated from both sides of the firearm in order to release the first adjustment device 6 in order to adjust the butt plate 5.

FIGS. 4A-4I show a second adjustment device 8 that is used to adjust the cheek piece 7 of the buttstock 4, where the second adjustment device 8 comprises an element 30 that is to be fixed to the cheek piece 7 and where the element 30 is guided through a housing 42.

The element 30 and the cheek piece 7 is fixed to each other through fastening means such as screws 55, bolts or the like, whereby the element 30 and the cheek piece 7 are provided with a number of corresponding bores 53.

The element 30 comprise two spaced apart guiding rods 31 and two spaced apart locking elements 32 in the form of a U, where one guiding rod 31 is arranged towards each end of the element 30, and the locking elements 32 are arranged between the guiding rods 31. Furthermore, each of the two locking elements 32 are provided with a plurality of teeth 33 on a surface facing the other locking element 32, where the plurality of teeth 33 is provided over a part of a length of the locking elements 32.

The guiding rods 31 are, in order to save weight, hollow, but it should be understood that the guiding elements 31 also could be solid.

At least one of the guiding rods 31 is provided with a through-going slot 34 extending over a part of a length of the guiding rod 31, where this through-going slot 34 will receive and accommodate a pin (not shown) or a bolt in order to prevent the cheek piece 7 to be removed completely from the buttstock 4 when the second locking and releasing device 8 is in an unlocked or released state, for instance when the cheek piece 7 is to be adjusted to the user. The pin or bolt may then in appropriate ways be fixed to the housing 42 of the second adjustment device 8 or also to the buttstock 4. As is to be understood, the pin or bolt may be removed from the housing 42 or the buttstock 4, whereby this will allow the cheek piece 7 to be completely removed from the buttstock 4.

From FIGS. 4G and 4H it can be seen that the second locking and releasing button 10 of the second adjustment device 8 comprises a first part 10A and a second part 10B, where one end of the first part 10A is in the form of a button and where a solid part will extend out from the button. The solid part has a rectangular form, with a thickness, a length and a height. A plurality of teeth 35 is provided on opposite sides of the solid part, where these teeth 35 will have a form that will cooperate with the teeth 33 provided on the locking elements 32. An aperture 36 is furthermore provided between the plurality of teeth 35, where the aperture 36 will extend a length into the solid part and being of such a size that it can receive and accommodate a spring 37 and a ball 38. The plurality of teeth 35 and the aperture 36 will be arranged to extend perpendicular to the longitudinal direction of the first part 10A.

On an opposite side of the button, at the end of the solid part, the solid part is provided with two projections 39 and a throughgoing hole 41 between the two projections 39, where the two projections 39 and the throughgoing hole 41 will extend in the longitudinal direction of the first part 10A.

Similarly, one end of the second part 10B of the locking and releasing button 10 of the second adjustment device 8 is in the form of a button, where a solid part extends out from the button. An end of the solid part, on an opposite side of the button, is provided with two grooves 40 or notches and a throughgoing hole 56, where the two grooves 40 or notches will extend in the longitudinal direction of the second part 10B. When the first and second part 10A, 10B of the locking and releasing button 10 of the second adjustment device 8 are assembled, the two projections 39 of the first part 10A will be accommodated in corresponding two grooves 40 or notches of the second part 10B. A bolt 57, screw or the like is then used to lock the two parts 10A, 10B to each other.

FIG. 4F shows the housing 42 which is to accommodate the second adjustment device 8, where it can be seen that the housing 42 is provided with two guiding bushes 44 for the reception and accommodation of the guiding rods 31 of the element 30 and a central opening 58 for accommodation of the locking elements 32. Furthermore, the housing is provided with three positioning cavities 45, 46 or hollows in a throughgoing opening 43.

In FIGS. 4B-4C is shown how the second adjustment device 8 arranged in the housing 42, and where the plurality of teeth 35 provided on the locking and releasing button 10 are brought into abutment with the plurality of teeth 33 provided on the locking elements 32. In this position adjustment device 8 is locked and the cheek piece 7 cannot be adjusted. The ball 38 is then positioned in the positioning cavity 46 provided in the throughgoing opening 43 of the housing 42.

In FIG. 4C is shown the position of the locking and releasing button 10 in an unlocked or released state, where the locking and releasing button 10 has been pushed transversely relative the buttstock 4. Through this movement of the locking and releasing button 10, the ball 38 has been pushed out of the abutment with the positioning cavity 46 provided in the throughgoing opening 43 of the housing 42 and been brought into the positioning cavity 45 on either side of the positioning cavity 46. In this position the plurality of teeth 35 provided on the locking and releasing button 10 has been brought out of abutment with the plurality of teeth 33 provided on the locking elements 32, whereby the element 30 is free to move relative the locking and releasing button 10 and the housing 42.

FIGS. 5A-5F show an adjustment device for the butt plate 5 mounted to the buttstock 4 through the housing 18 and the first adjustment device 6, whereby the butt plate 5 can be adjusted in height and/or angle relative the buttstock 4.

When the first adjustment device 6 is brought to an unlocked or released state as described in accordance with FIG. 3C, the butt plate 5 can be pushed out from the housing 18, whereby the adjustment device 60 for the butt plate 5 will be exposed. The adjustment device 60 for the butt plate 5 comprises a recoil adapter plate 5A, a recoil pad 5B and a locking piece 5*c*, where the recoil adapter plate 5A, the recoil pad 5B and the locking piece 5C are provided with a throughgoing hole such that a bolt 61 can extend through them and be secured in appropriate ways in the recoil pad 5B. The bolt 61 will also extend through the butt plate 5 and a spring 62 will be arranged between the butt plate 5 and the bolt 61.

Figure 5A:
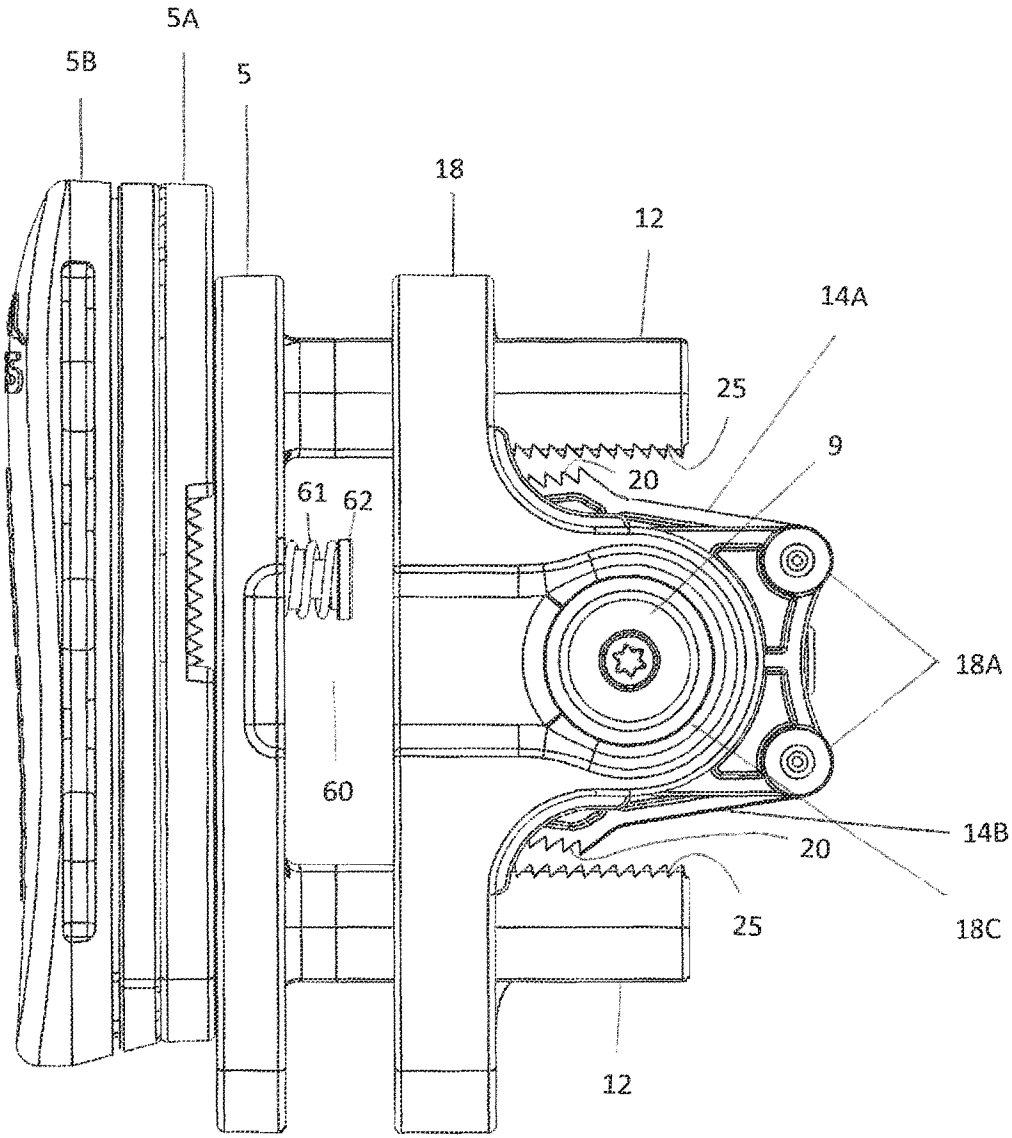
Figure 5B:
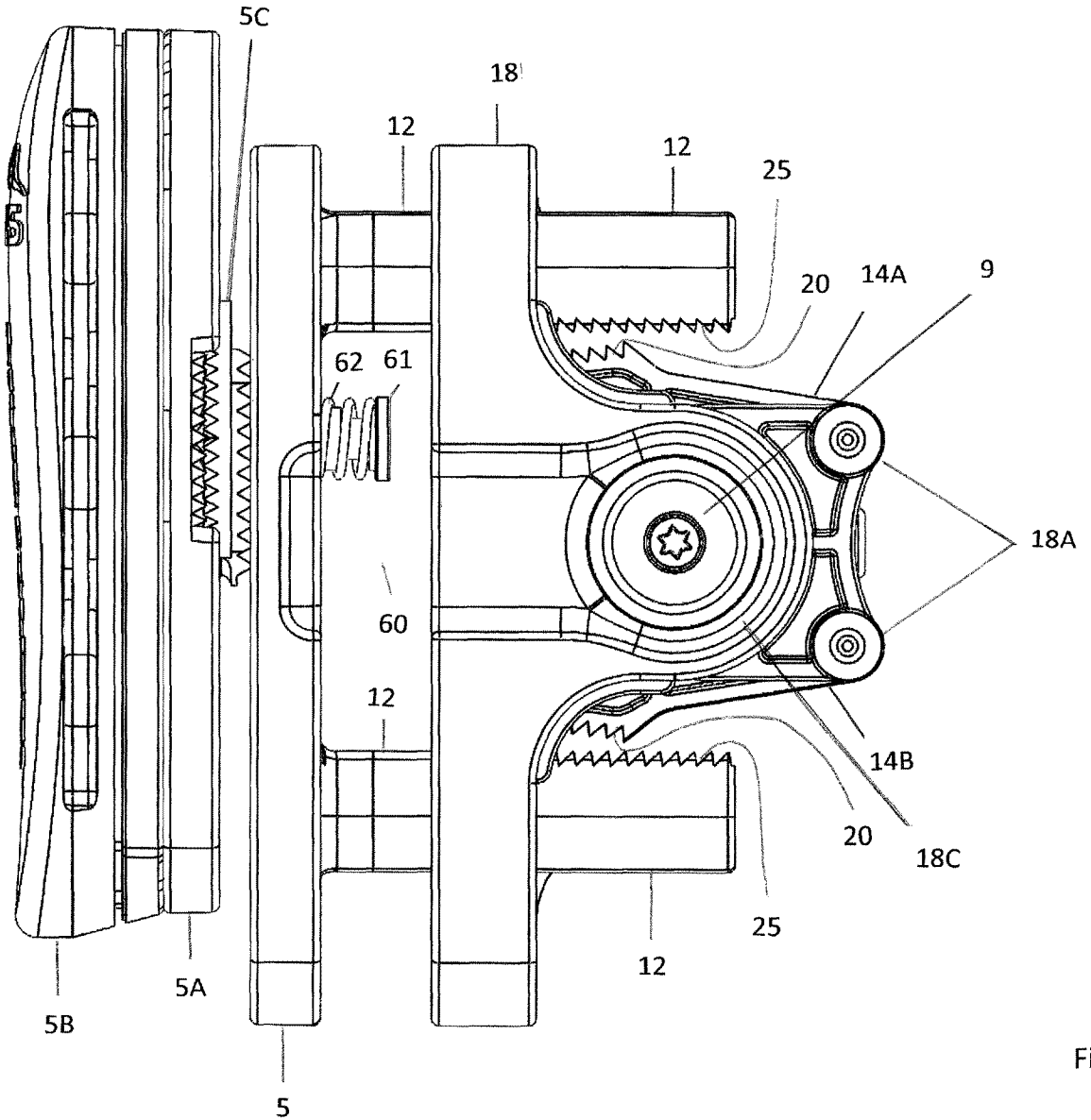
Figure 5C:
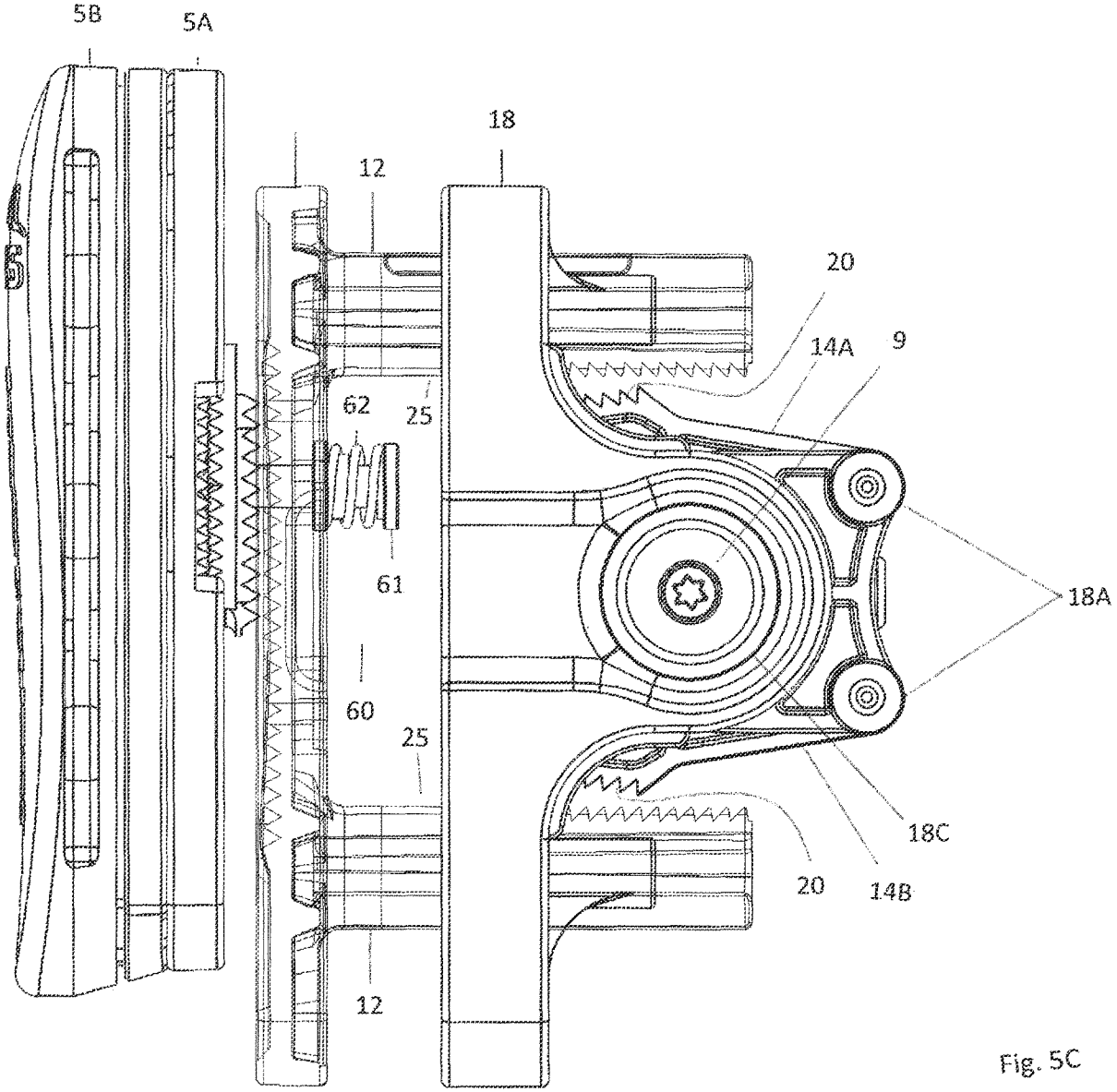
Figure 5D:
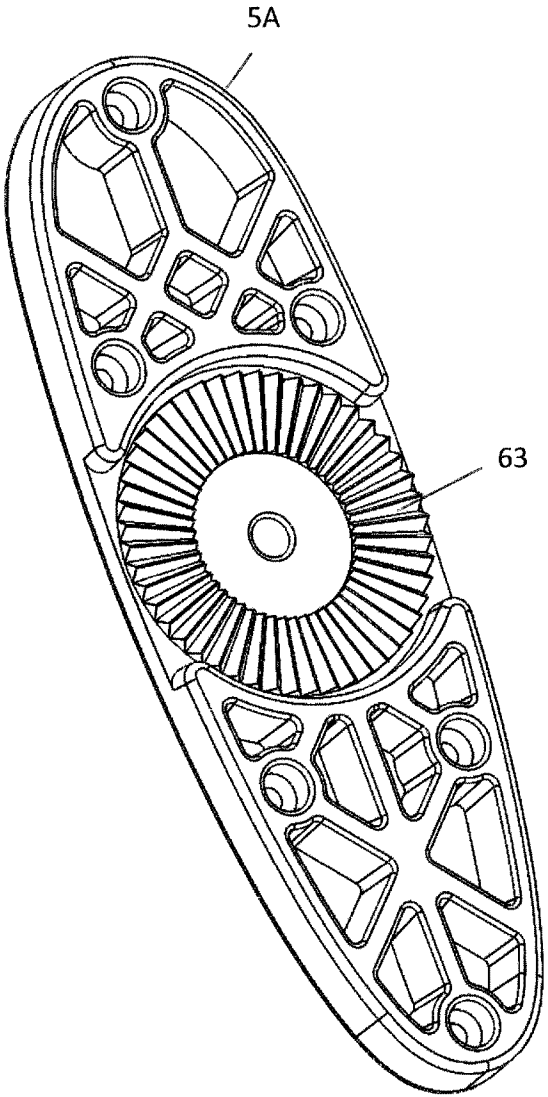

As can be seen from FIG. 5D, the recoil adapter plate 5A is provided with a plurality of teeth 63, where the plurality of teeth 63 are arranged to have an annular form.

Figure 5E:
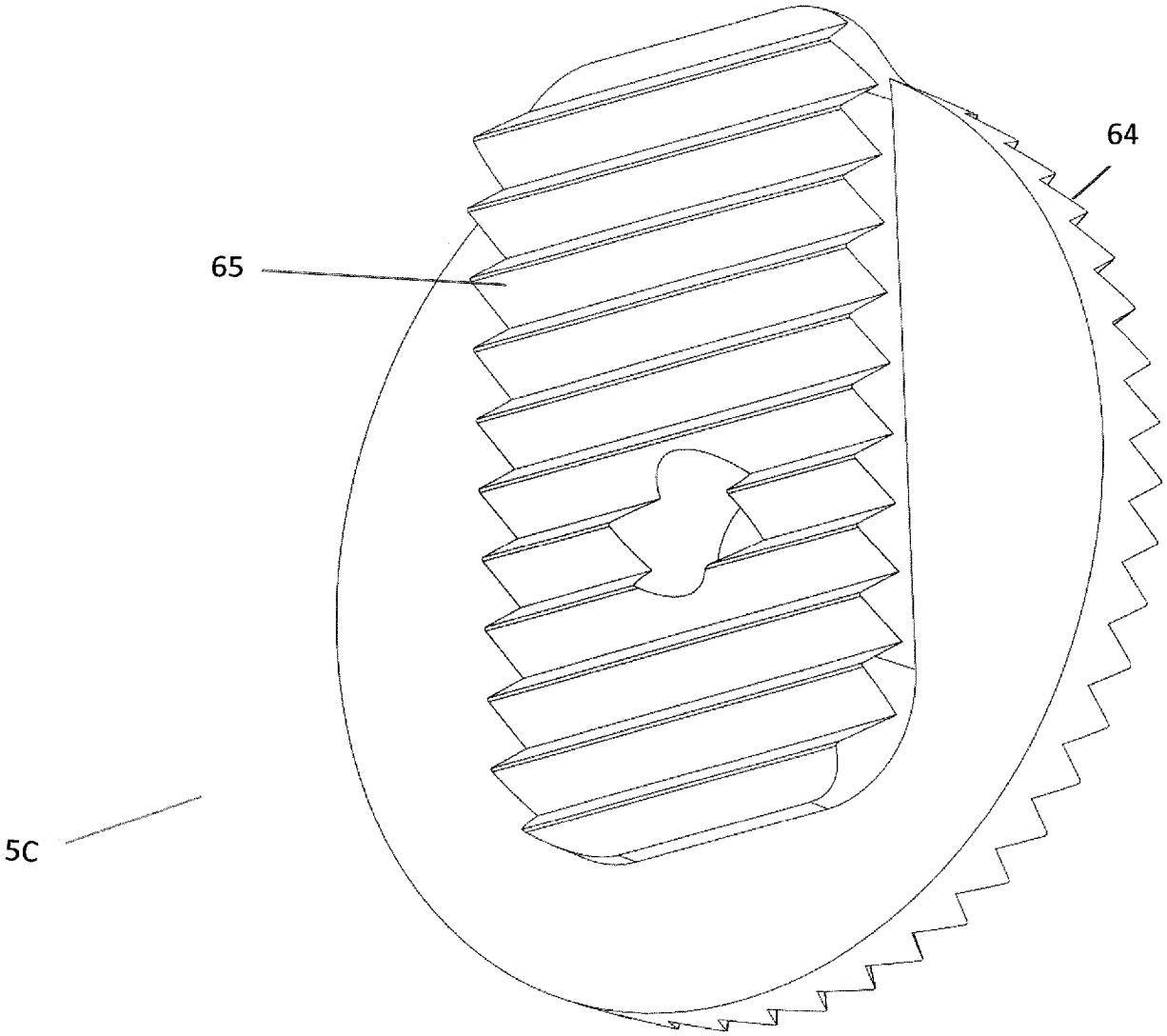
Figure 5F:
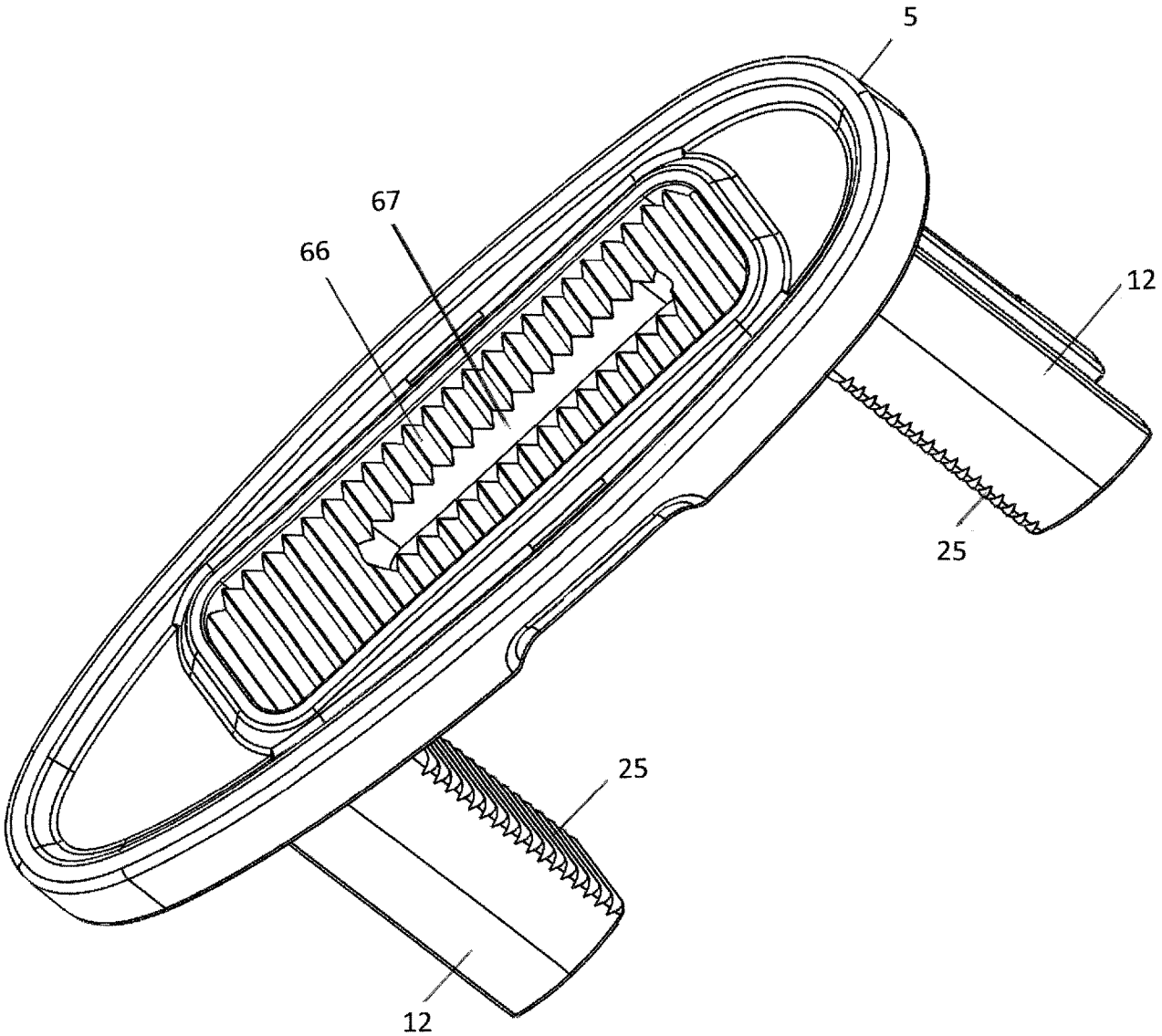

In FIG. 5E is shown that the locking piece 5*c* is circular, where one side of the locking piece 5*c* is provided with a plurality of teeth 64 arranged in an annular form, while the opposite side of the locking piece 5C is provided with a plurality of teeth 65.

The butt plate 5 is also provided with a plurality of teeth 66 on a side that face the recoil adapter plate 5A and a throughgoing recess 67, such that the recoil pad 5B can be moved relative the butt plate 5 when the recoil pad 5B is to be adjusted in a height direction.

When the recoil pad 5B, the recoil adapter plate 5A and the locking piece 5C are assembled and held together with the bolt 61 and the spring 62, the plurality of teeth 64 of the locking piece 5C will be in abutment with the plurality of teeth 63 provided on the recoil adapter plate 5A, while the plurality of teeth 65 of the locking piece 5C will be in abutment with the plurality of teeth 66 provided on the butt plate 5. The adjustment device 60 will now be in a locked state, and the recoil pad 5B and the recoil adapter plate 5A cannot be adjusted relative the butt plate 5. The locked state of the adjustment device 60 is shown in FIG. 5A.

However, if the bolt 61 and the spring 62 is pushed towards the butt plate 5, and thereby being compressed, as shown in FIGS. 5B and 5C, the teeth 64, 65 of the locking piece 5*c* will be brought out of abutment with the teeth 66 provided on the butt plate 5 and/or the teeth 63 provided on the recoil adapter plate 5C, whereby the recoil pad 5B and the recoil adapter plate 5A can be height and/or angle adjusted relative the butt plate 5. The compression of the spring 62 will decide if the recoil pad 5B and the recoil adapter plate 5A can be adjusted in the height or rotated relative the butt plate 5.

Only the elements relating to the invention are explained and described above and a skilled person will understand that the modular stock comprising the first adjustment device for the butt plate and the second adjustment device for the cheek piece can be designed with more or fewer elements which are assembled to each other. The skilled person will further understand that, within the scope of the invention as defined in the appended claims, more embodiments and modifications of the described and illustrated embodiments can be provided.

The invention claimed is:

1. A modular stock for a firearm, said modular stock comprising a foremost stock, an intermediate stock part and a buttstock, a butt plate mounted to the buttstock by a first adjustment device and a cheek piece mounted to the buttstock by a second adjustment device, wherein the first adjustment device comprises a first locking and releasing button, wherein the first locking and releasing button is bilaterally operable, and wherein the first adjustment device further comprises two locking claws, a tension spring, a compression spring and a ball.

2. The modular stock according to claim 1, wherein a through-going hole is provided at one end of the locking claw and a plurality of teeth are provided at an opposite end of the locking claw.

3. The modular stock according to claim 2, wherein the locking, on an opposite side of the plurality of teeth, is provided with a lifting eye and a cam.

4. The modular stock according to claim 1, wherein the first locking and releasing button has a circular cross-section, and wherein the cross-section varies over a length of the first locking and releasing button, from a first diameter to a second diameter, the first diameter being smaller than the second diameter.

5. The modular stock according to claim 4, wherein a part of the first locking and releasing button, over a part of the length, is cut off, thereby providing a plane surface along the part of the length, and wherein a cavity or hollow is provided in the plane surface.

6. The modular stock according to claim 1, wherein the butt plate comprises two spaced apart guiding elements, and wherein each guiding element, on a surface facing the other guiding element, is provided with a plurality of teeth.

7. The modular stock according to claim 6, wherein at least one of the guiding elements, on an opposite side of the plurality of teeth, is provided with a recess.

8. The modular stock according to claim 1, wherein the first locking and releasing button comprises a first part and a second part, and wherein the first part is provided with a plurality of teeth on opposite sides of a plane surface extending over a length of the first locking and releasing button, an aperture further being provided between the plurality of teeth, the aperture extending a length into the first part, a spring and a ball being arranged in the aperture.

9. Modular stock according to claim 8, wherein the first part of the first locking and releasing button, at one end, further comprises one or more projections, the second part comprising a same number of corresponding grooves, the first and second part further being provided with a throughgoing hole for fastening means extending in a longitudinal direction of the first locking and releasing button.

10. The modular stock according to claim 1, wherein the locking claw, on an opposite side of the plurality of teeth, is provided with a lifting eye and a cam.

11. A modular stock for a firearm, said modular stock comprising a foremost stock, an intermediate stock part and a buttstock, a butt plate mounted to the buttstock by a first adjustment device and a cheek piece mounted to the buttstock by a second adjustment device, wherein the second adjustment device comprises a second locking and releasing button, and an element to be attached to the cheek piece, wherein the second locking and releasing button is bilaterally operable, and wherein the element comprises two spaced apart guiding rods and two spaced apart locking elements, and wherein each of the two locking elements on a surface facing each other is provided with a plurality of teeth over a part of a length of the locking element.

12. The modular stock according to claim 11, wherein at least one of the guiding rods is provided with a throughgoing slot extending over a part of a length of the guiding rod.

13. The modular stock according to claim 11, wherein the second adjustment device further comprises a housing, the housing comprising a first throughgoing opening for reception and accommodation of the second locking and releasing button, a second throughgoing opening for reception and accommodation of the locking elements of the element, the first and second throughgoing openings being arranged perpendicularly to each other, and two guiding bushes for the reception and accommodation of the guiding rods of the element, and wherein three positioning cavities or hollows are provided in the throughgoing opening.

14. The modular stock according to claim 13, wherein the three positioning cavities or hollows provided in the throughgoing opening have different sizes, the largest positioning cavity or hollow being arranged between the two smaller positioning cavities or hollows.

* * * * *